US012753760B2

(12) United States Patent
Noh et al.

(10) Patent No.: US 12,753,760 B2
(45) Date of Patent: Oct. 6, 2026

(54) ROTARY COMPRESSOR AND REFRIGERATION CYCLE DEVICE HAVING THE SAME

(71) Applicant: LG ELECTRONICS INC., Seoul (KR)

(72) Inventors: Kiyoul Noh, Seoul (KR); Yunhi Lee, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 210 days.

(21) Appl. No.: 18/882,955

(22) Filed: Sep. 12, 2024

(65) Prior Publication Data

US 2025/0129779 A1 Apr. 24, 2025

(30) Foreign Application Priority Data

Oct. 19, 2023 (KR) ..... 10-2023-0140562

(51) Int. Cl.
*F04C 29/12* (2006.01)
*F04C 18/356* (2006.01)
*F25B 31/02* (2006.01)

(52) U.S. Cl.
CPC ..... *F04C 18/3568* (2013.01); *F04C 29/12* (2013.01); *F25B 31/026* (2013.01); *F04C 2240/50* (2013.01); *F25B 2400/0409* (2013.01); *F25B 2400/0411* (2013.01)

(58) Field of Classification Search
CPC F04C 18/344; F04C 18/3441; F04C 18/3568; F04C 29/042; F04C 29/12; F04C 2240/10; F04C 2240/20; F04C 2240/30; F04C 2240/50; F04D 17/10;
(Continued)

(56) References Cited

U.S. PATENT DOCUMENTS 2,523,317 A 9/1950 McGill
4,224,014 A 9/1980 Glanvall
(Continued)

FOREIGN PATENT DOCUMENTS

CN 102644591 8/2012
CN 107489619 7/2013
(Continued)

OTHER PUBLICATIONS

Machine Translation CN 107489619 (Year: 2025).*
(Continued)

*Primary Examiner* — Dapinder Singh
(74) *Attorney, Agent, or Firm* — KED & ASSOCIATES

(57) ABSTRACT

Disclosed are a rotary compressor and a refrigeration cycle device having the same. The rotary compressor and the refrigeration cycle device having the same may include a casing, a main bearing, a sub bearing, a cylinder, a roller, a vane, and an injection passage, and the injection passage may be disposed in at least one selected from the main bearing, the sub bearing, and the cylinder to communicate with a corresponding compression chamber after a compression start angle of the corresponding compression chamber. Thus, a maximum injection section may be secured, while a refrigerant being injected may be suppressed from being leaked toward a suction port.

16 Claims, 19 Drawing Sheets

(58) Field of Classification Search
CPC ..... F04D 29/5846; F25B 1/04; F25B 31/026; F25B 2400/0409; F25B 2400/0411
See application file for complete search history.

(56) References Cited

U.S. PATENT DOCUMENTS

| | | | | |
|---|---|---|---|---|
| 9,039,390 | B2 * | 5/2015 | Lee | F04C 29/0071 417/356 |
| 9,181,947 | B2 * | 11/2015 | Lee | F01C 21/02 |
| 2002/0021972 | A1 | 2/2002 | Vaisman | |
| 2010/0226796 | A1 * | 9/2010 | Kanayama | F04C 23/001 417/312 |
| 2014/0369878 | A1 | 12/2014 | Shimaguchi et al. | |
| 2019/0271314 | A1 * | 9/2019 | Hill | F04C 23/02 |

FOREIGN PATENT DOCUMENTS

| | | |
|---|---|---|
| JP | 62-251482 | 11/1987 |
| JP | WO 2014/024517 | 7/2016 |
| JP | WO 2019/171508 | 9/2019 |

OTHER PUBLICATIONS

European Search Report issued in Application No. 24206634.8 dated Jan. 16, 2025.
Korean Office Action issued in Application No. 10-2013-0140562 dated Jan. 20, 2025.

* cited by examiner

ROTARY COMPRESSOR AND REFRIGERATION CYCLE DEVICE HAVING THE SAME

CROSS-REFERENCE TO RELATED APPLICATION

Pursuant to 35 U.S.C. § 119(a), this application claims the benefit of the earlier filing date and the right of priority to Korean Patent Application No. 10-2023-0140562, filed on Oct. 19, 2023, the contents of which are incorporated by reference herein in their entirety.

TECHNICAL FIELD

This disclosure relates to a rotary compressor and a refrigeration cycle device having the same.

BACKGROUND

Rotary compressors may be classified into two types, namely, a type in which a vane is slidably inserted into a cylinder to be in contact with a roller, and another type in which a vane is slidably inserted into a roller to be in contact with a cylinder. In general, the former is called a roller eccentric rotary compressor (hereinafter, referred to as a "rotary compressor"), and the latter is referred to as a vane concentric rotary compressor (hereinafter, referred to as a "concentric rotary compressor").

As for a rotary compressor, a vane inserted in a cylinder is pulled out toward a roller by elastic force or back pressure to come into contact with an outer circumferential surface of the roller. The rotary compressor independently forms compression chambers as many as the number of vanes per revolution of the roller, and the compression chambers simultaneously perform suction, compression, and discharge strokes.

On the other hand, as for a concentric rotary compressor, a vane inserted in a roller rotates together with the roller, and is pulled out by centrifugal force and back pressure to come into contact with an inner circumferential surface of a cylinder. The concentric rotary compressor continuously forms as many compression chambers as the number of vanes per revolution of the roller, and the compression chambers sequentially perform suction, compression, and discharge strokes. Accordingly, the concentric rotary compressor has a higher compression ratio than a general rotary compressor. Therefore, the concentric rotary compressor is more suitable for high pressure refrigerants such as R32, R410A, or CO2, which have low ozone depletion potential (ODP) and global warming index (GWP).

In these related art concentric rotary compressors, a contact point at which an outer circumferential surface of the roller and an inner circumferential surface of the cylinder are substantially in contact with each other is located between a discharge port and a suction port, so as to separate the discharge port and the suction port from each other. An example of a concentric rotary compressor to which one suction port is applied is illustrated. In other words, in concentric rotary compressors in the related art, when a refrigerant is sucked through one suction port, the refrigerant may be sucked sequentially into respective compression chambers, compressed, and then, discharged. In such concentric rotary compressors, since an amount of refrigerant sucked into the respective compression chambers is limited, compression efficiency may be limited.

As another example, an injection passage may be disposed in a concentric rotary compressor having a plurality of contact points. In this concentric rotary compressor, the injection passage equipped in a main bearing and/or a sub bearing and a roller may periodically communicate with compression chambers. As described above, in a concentric rotary compressor capable of performing injection, although an injection passage may be covered by a roller, since the injection passage is adjacent to a vane slot, a refrigerant being injected may leak into an adjacent compression chamber through the vane slot, thereby resulting in a suction loss in the corresponding compression chamber.

As another example, in a rotary compressor, an injection passage disposed in a main bearing may be opened or closed by rotation of a roller. In the rotary compressor having the injection passage, as the injection passage may be opened or closed by the roller, a sectional area of the injection passage may not be sufficiently secured, thereby limiting a flow rate of a refrigerant.

SUMMARY

Therefore, the present disclosure describes a rotary compressor capable of increasing a compression capacity through injection, and a refrigeration cycle device having the same.

The present disclosure also describes a rotary compressor capable of suppressing leakage of a refrigerant being injected toward a suction port while securing an injection section at maximum, and a refrigeration cycle device having the rotary compressor.

The present disclosure further describes a rotary compressor capable of increasing a flow rate of injection by optimizing a specification of an injection passage, and a refrigeration cycle device having the rotary compressor.

The present disclosure further describes a rotary compressor capable of increasing a flow rate of injection by securing a substantial sectional area of an injection passage at maximum, and a refrigeration cycle device having the rotary compressor.

The present disclosure further describes a rotary compressor capable of quickly discharging a residual refrigerant even when a high-pressure refrigerant such as R32, R410A, or CO2 is used, and a refrigeration cycle device having the rotary compressor.

In order to achieve these and other advantages and in accordance with the purpose of this specification, as embodied and broadly described herein, there is provided a rotary compressor including a casing, a main bearing and a sub bearing, a cylinder, a roller, a plurality of vanes, and an injection passage. The main bearing and the sub bearing may be each disposed in an inner space of the casing. The cylinder may be disposed between the main bearing and the sub bearing to define a compression space. The roller may be disposed on a rotating shaft to be rotatable in an inner space of the cylinder and eccentrically located with respect to a center of the compression space to have a contact point close to an inner circumferential surface of the cylinder. The plurality of vanes may be slidably inserted into a plurality of vane slots disposed in the roller, respectively, and configured to rotate together with the roller to divide the compression space into a plurality of compression chambers. The injection passage may inject a part of refrigerant having been discharged from the compression space and condensed into the compression space. In this case, the injection passage may be disposed in at least one among the main bearing, the sub bearing, and the cylinder to communicate with a corresponding compression chamber among the plurality of compression chambers, after a compression start angle of the corresponding compression chamber. Thus, a maximum injection section may be secured, while a refrigerant being injected may be suppressed from being leaked toward a suction port.

As an example, the injection passage may satisfy θ≤an application area of the injection passage≤θ+360/n, where θ is the compression start angle and n is a number of the plurality of vanes. By doing so, the injection passage may communicate with neither a compression chamber in which a suction stroke is performed, nor a compression chamber in which a discharge stroke has been completed. Thus, a suction loss due to a refrigerant being injected may be prevented in a corresponding compression chamber in advance, and the refrigerant in the compression chamber may be suppressed from flowing back into the injection passage.

For example, a circumferential width of the injection passage may be configured as 0.4 to 0.8 times a thickness of each of the plurality of vanes. Thus, good compression efficiency may be exhibited regardless of an operating condition of a compressor (an injection operation or a normal operation).

In detail, the injection passage may be disposed to communicate with the corresponding compression chamber within a range of 20° after the compression start angle with reference to a rotational direction of the roller. By doing so, a communication position in which the injection passage communicates with the corresponding compression chamber may be close to the compression start angle of the corresponding compression chamber as possible to secure an injection flow rate.

In another example, the suction guide may be disposed through an outer circumferential surface of the cylinder to an inner circumferential surface of the cylinder. Thus, a length of the injection passage may be minimized to allow a refrigerant to be quickly injected into the plurality of compression chambers during an injection operation For example, the injection passage may include an injection inlet recessed from the outer circumferential surface of the cylinder toward the inner circumferential surface of the cylinder by a preset depth, and an injection outlet in communication with the injection inlet to penetrate through the inner circumferential surface of the cylinder, and the injection outlet may be disposed in plurality, and the plurality of injection outlets may be arranged to be apart from each other by a preset distance in an axial direction. Thus, one injection outlet may be configured to have a small sectional area, but a sectional area of the whole injection outlets may be enlarged to increase a flow rate of the refrigerant injected into the compression chambers during an injection operation. Accordingly, compression efficiency may be increased.

In addition, the injection passage may be configured such that an axial length is greater than a circumferential length. By doing so, a substantial size of the injection passage may be increased when conditions such as a location and a specification of the injection passage are identical.

As another example, the injection passage may be disposed in at least one of the main bearing and the sub bearing. By doing so, behavior of the plurality vanes becomes stable during an injection operation, and performance of a compressor may be improved. In addition, an increase in a surface pressure between the plurality of vanes and the cylinder may be suppressed, thereby improving reliability, and leakage between compression chambers may be effectively suppressed compared to an injection structure of the cylinder.

For example, the injection passage may include an injection inlet recessed from an outer circumferential surface of the main bearing or an outer circumferential surface of the sub bearing toward an inner circumferential surface of the main bearing or an inner circumferential surface of the sub bearing by a preset depth, and an injection outlet in communication with the injection inlet to penetrate through a sliding surface toward the compression space. Accordingly, the injection inlet may come into contact with an inner circumferential surface of the casing to easily couple the injection pipe into the injection passage, while tightly sealing a space between the injection passage and the injection pipe.

In detail, the injection outlet may be configured as one injection outlet. Thus, the injection passage may be disposed in the main bearing and/or the sub bearing, and a length of the injection inlet may be minimized to allow a refrigerant to be quickly injected into the plurality of compression chambers during an injection operation In addition, the injection outlet may be configured such that a radial length is greater than a circumferential length. By doing so, a substantial size of the injection passage directly in communication with the compression chambers may be increased when conditions such as a location and a specification of the injection passage are identical.

In addition, the plurality of vanes may be disposed to be inclined at a preset angle with respect to a radial direction with reference to a rotation center of the roller. The injection outlet may be disposed to have a length in a direction in which the plurality of vanes are inclined. By doing so, a substantial size of the injection passage in communication with the compression chambers may be increased when conditions such as a location and a specification of the injection passage are identical.

For example, the injection passage may include a first injection passage, a second injection passage, and an injection connection passage. The first injection passage may be disposed in one bearing among the main bearing and the sub bearing. The second injection passage may be disposed in another bearing among the main bearing and the sub bearing, wherein the first injection passage is not disposed in the another bearing. The injection connection passage may connect the first injection passage to the second injection passage. Thus, since one injection pipe communicates with a plurality of injection passages, a whole area of the injection passage may be enlarged, and thus, an injection effect may be enhanced.

In detail, the injection connection passage may be disposed through both axial side surfaces of the cylinder. Thus, the injection passage may be disposed in both bearings, respectively, while the injection passage may be sealed stably.

For example, the injection passage may include an injection hole penetrating through both axial side surfaces of the main bearing or the sub bearing, and an injection pipe connected into the injection hole from outside of the main bearing or the sub bearing. By doing so, since the injection pipe may be immersed in oil stored inside the casing, some of a liquid refrigerant injected through the injection pipe may evaporate, thereby reducing a flow of the liquid refrigerant into the compression space.

In detail, the injection pipe may penetrate through a side surface of the casing to be bent in a curved line toward the injection hole. Thus, a length of the injection passage may be minimized to easily machine the injection passage.

In detail, a discharge port may be disposed in the main bearing, and the injection passage may be disposed in the sub bearing. By doing so, since the injection passage is disposed in the sub bearing having a relatively simple structure, the injection passage may be easily machined, and the injection pipe may be easily connected to the injection passage.

As still another example, a valve accommodating space may be disposed in the injection passage, and an injection check valve configured to open or close the injection passage by sliding according to a pressure difference may be disposed in the valve accommodating space. Thus, dead volume due to the injection passage may be minimized.

For example, a valve support surface configured to limit movement of the injection check valve in a closing direction may be disposed on an inner circumferential surface of the valve accommodating space. An injection pipe disposed to have the injection check valve between the valve support surface and the injection pipe and configured to limit movement of the injection check valve may be inserted into a side opposite to the valve support surface. This may simplify a structure of the injection check valve to reduce a manufacture cost.

In addition, an elastic member configured to elastically support the injection check valve in a closing direction may be disposed in the valve accommodating space. This may cause the injection check valve to be quickly closed to suppress leakage of a refrigerant in the compression chambers.

As still another example, a valve accommodating groove in which an injection check valve configured to open or close the injection passage is accommodated may be disposed in an inner side surface defining the compression space in the main bearing, the sub bearing, and the cylinder to communicate with the injection passage. A valve support member having a valve support surface to fix one end of the injection check valve and limit an opening amount of another end of the injection check valve may be inserted into the valve accommodating groove to have the injection check valve between the valve accommodating groove and the valve support member. The injection passage may be disposed to extend between an inner circumferential surface of the valve accommodating groove and an outer circumferential surface of the valve support member. Thus, behavioral reliability of the injection check valve configured as a reed valve may be enhanced to stable open or close the injection passage.

For example, a valve pressure hole may be disposed in the valve support member to penetrate through an inner circumferential surface defining the compression chamber to the valve support surface. Accordingly, the injection check valve configured as a reed valve may be quickly closed to thereby suppress leakage of a refrigerant in the compression chambers.

As still another example, a valve accommodating groove in which an injection check valve configured to open or close the injection passage is accommodated may be disposed in outer surfaces of the main bearing, the sub bearing, and the cylinder to communicate with the injection passage. A valve support member configured to fix one end of the injection check valve and support another end of the injection check valve may be inserted into the valve accommodating groove to have the injection check valve between the valve accommodating groove and the valve support member. An injection hole defining the injection passage may be disposed in the valve support member. Thus, the injection check valve configured as a reed valve may be easily installed to reduce a manufacture cost.

For example, a valve support member configured to limit an opening amount of the another end of the injection check valve may be disposed on one side surface of the valve accommodating groove. A valve pressure hole penetrating through the valve support surface may be disposed at one side of the injection passage. Accordingly, the injection check valve configured as a reed valve may be quickly closed to thereby suppress leakage of a refrigerant in the compression chambers.

In order to achieve those aspects and other advantages of the present disclosure, there is also provided a refrigeration cycle device including a compressor, a condenser, an expander, and an evaporator. The rotary compressor described above may be used as the compressor. Thus, a maximum injection section may be secured, while a refrigerant being injected may be suppressed from being leaked toward a suction port. Thus, cooling power of the refrigeration cycle device may be increased.

As an example, an injection portion branched between the condenser and the expander to be connected to the injection passage may be disposed, and an injection control valve configured to selectively open or close the injection portion is disposed in the injection portion. The injection control valve may be controlled such that a pressure of a refrigerant injected into a corresponding compression chamber is 0.4 to 0.7 times a discharge pressure of a refrigerant discharged from the corresponding compression chamber. Thus, good compression efficiency may be achieved regardless of an operating condition of the compressor (an injection operation or a normal operation).

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Description will now be given in detail of a concentric rotary compressor according to exemplary embodiments disclosed herein, with reference to the accompanying drawings. The present embodiment describes a structure in which an injection passage is defined in a cylinder, which may be equally applied to a concentric rotary compressor in which a vane is slidably inserted into a roller. For example, the present disclosure may be equally applicable not only to a concentric rotary compressor having an elliptical (hereinafter, asymmetric elliptical) cylinder, an inner circumferential surface of which has a plurality of curvatures, but also to a concentric rotary compressor having a circular cylinder, an inner circumferential surface of which has one curvature. The present embodiment may also be equally applicable to a concentric rotary compressor in which a vane slot into which a vane is slidably inserted is inclined by a preset angle with respect to a radial direction of a roller, as well as a concentric rotary compressor in which a vane slot is disposed in a radial direction of a roller. Hereinafter, an example in which an inner circumferential surface of a cylinder has an asymmetric elliptical shape and a vane slot is inclined with respect to a radial direction of a roller will be described as a representative example.

Figure 1:
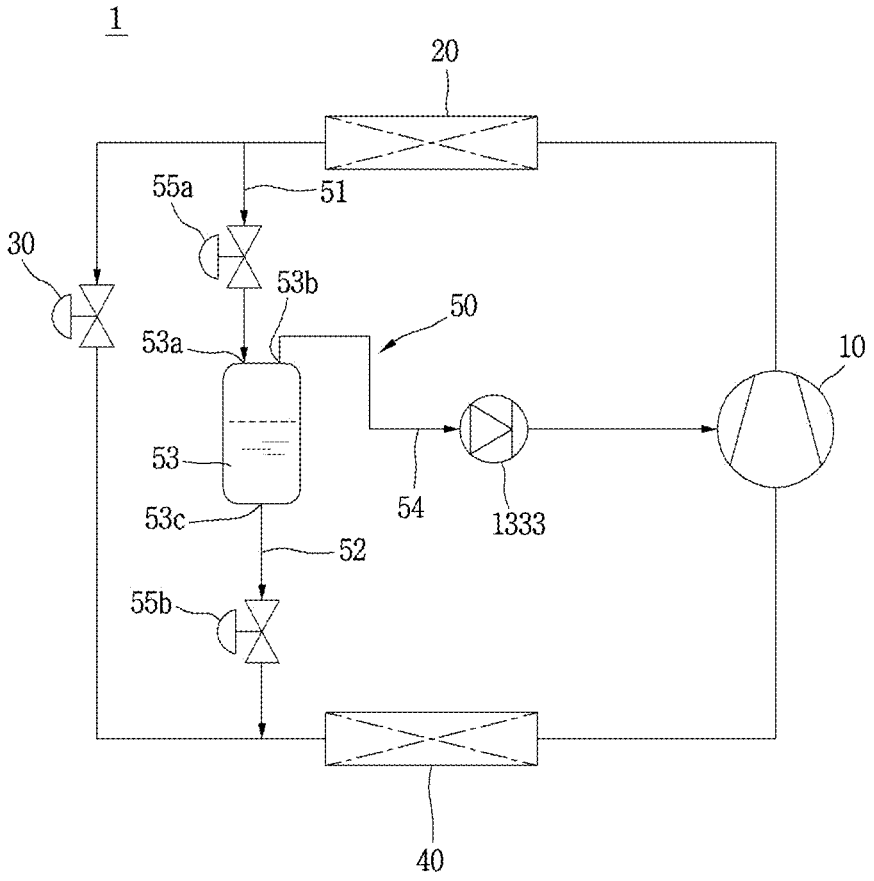
FIG. 1 is a schematic view illustrating a refrigeration cycle device to which a rotary compressor according to the present embodiment is applied.

FIG. 1 is a schematic view illustrating a refrigeration cycle device to which a rotary compressor according to the present embodiment is applied.

Referring to FIG. 1, a refrigeration cycle device 1 according to the present embodiment includes a compressor 10, a condenser 20, an expander 30, and an evaporator 40. In other words, the condenser 20, the expander 30, and the evaporator 40 are sequentially connected to a discharge side of the compressor 10 and the evaporator 40 is connected to a suction side of the compressor 10. Accordingly, the compressor 10, the condenser 20, the expander 30, and the evaporator 40 may be disposed to define a closed loop.

Also, the refrigeration cycle device 1 according to the present embodiment may further include an injection portion 50. In other words, a first branch tube 51 may be branched from a refrigerant circulation pipe 60 between an outlet of the condenser 20 and an inlet of an expander 30, an inlet 53*a* of an evaporation vessel 53 (a flash tank or a heat exchanger) may be connected to the first branch tube 51, a first outlet 53*b* of the evaporation vessel 53 (or the heat exchanger) may be connected to the refrigerant circulation pipe 60 between the expander 30 and the evaporator 40 through a second branch tube 52, and a second outlet 53*c* of the evaporation vessel 53 (or the heat exchanger) may be connected to an injection passage 1332 of the compressor 10, which will be described later, through an injection pipe 54. Accordingly, a gas refrigerant and/or some liquid refrigerants evaporated in the evaporation vessel 53 (or the heat exchanger) may be injected through the injection pipe 54 and the injection passage 1332 that will be described later into a compression chamber V1, V2, or V3 in which compression is being performed. to thereby increase a compression capacity of the corresponding compression chamber V1, V2, or V3.

In this case, injection control valves 55*a* and 55*b* including first and second injection control valves 55*a* and 55*b* may be disposed in a middle portion of the first branch tube 51 and/or a middle portion of the second branch tube 52, respectively. In the present embodiment, an example in which the first injection control valve 55*a* is located in the middle portion of the first branch tube 51, and the second injection control valve 55*b* is located in the middle portion of the second branch tube 52 is illustrated. Accordingly, an opening amount of the first injection control valve 55*a* and the second injection control valve 55*b* may be controlled to thereby control a flow rate and a pressure of a refrigerant flowing into the injection pipe 54. A proper pressure of the refrigerant injected using the first injection control valve 55*a* and the second injection control valve 55*b* will be described again later together with the injection passage 1332.

In addition, since the refrigerant injected into the compression chambers V1, V2, and V3 moves due to a pressure difference between the evaporation vessel 53 and the compression chambers V1, V2, and V3, it may be advantageous to dispose the injection passage 1332 in a position as close to a suction port 1331 as possible while the refrigerant does not flow back into the suction port 1331, in terms of performing injection. In other words, in a concentric rotary compressor in which one compression space V is divided into a plurality of the compression chambers V1, V2, and V3, the injection passage 1332 may be disposed to communicate with the compression space V in a position circumferentially spaced apart from the suction port 1331 in correspondence with a section defined by one compression chamber V1, V2, or V3, e.g., in a section defined by the compression chamber V1, V2, or V3 after a compression start angle θ. This allows the injection passage 1332 to be adjacent to the suction port 1331 but separated from the suction port 1331, thereby maximizing an injection flow rate, and simultaneously, suppressing a suction loss due to the injection. An appropriate position of the injection passage 1332 will be described later.

In the refrigeration cycle device 1 as described above, a refrigerant compressed in the compressor 10 is discharged to an inner space in a casing 110 of the compressor 10 to be described later, and the refrigerant is discharged toward the condenser 20 through the refrigerant discharge pipe 116 to be described later, then, sequentially passes through the expander 30 and the evaporator 40, and then, is sucked back into the compressor 10 through a refrigerant suction pipe 115 to be described later.

At this time, a portion of the refrigerant having passed through the condenser 20 moves to the evaporation vessel 53 through the first branch tube 51 branched between the condenser 20 and the expander 30, and the refrigerant having moved to the evaporation vessel 53 is separated into a liquid refrigerant and a gas refrigerant. Then, the liquid refrigerant moves to the evaporator 40 through the second branch tube 52, and the gas refrigerant moves to the compressor 10 through the injection pipe 54, for example, to the compression chambers V1, V2, and V3 after the compression start angle θ, respectively. Accordingly, as an amount of the refrigerant in the compression chambers V1, V2, and V3 increases, compression efficiency may be improved. This may compensate for lack of a refrigerant that may occur under low-temperature heating and/or high-temperature cooling conditions.

Figure 2:
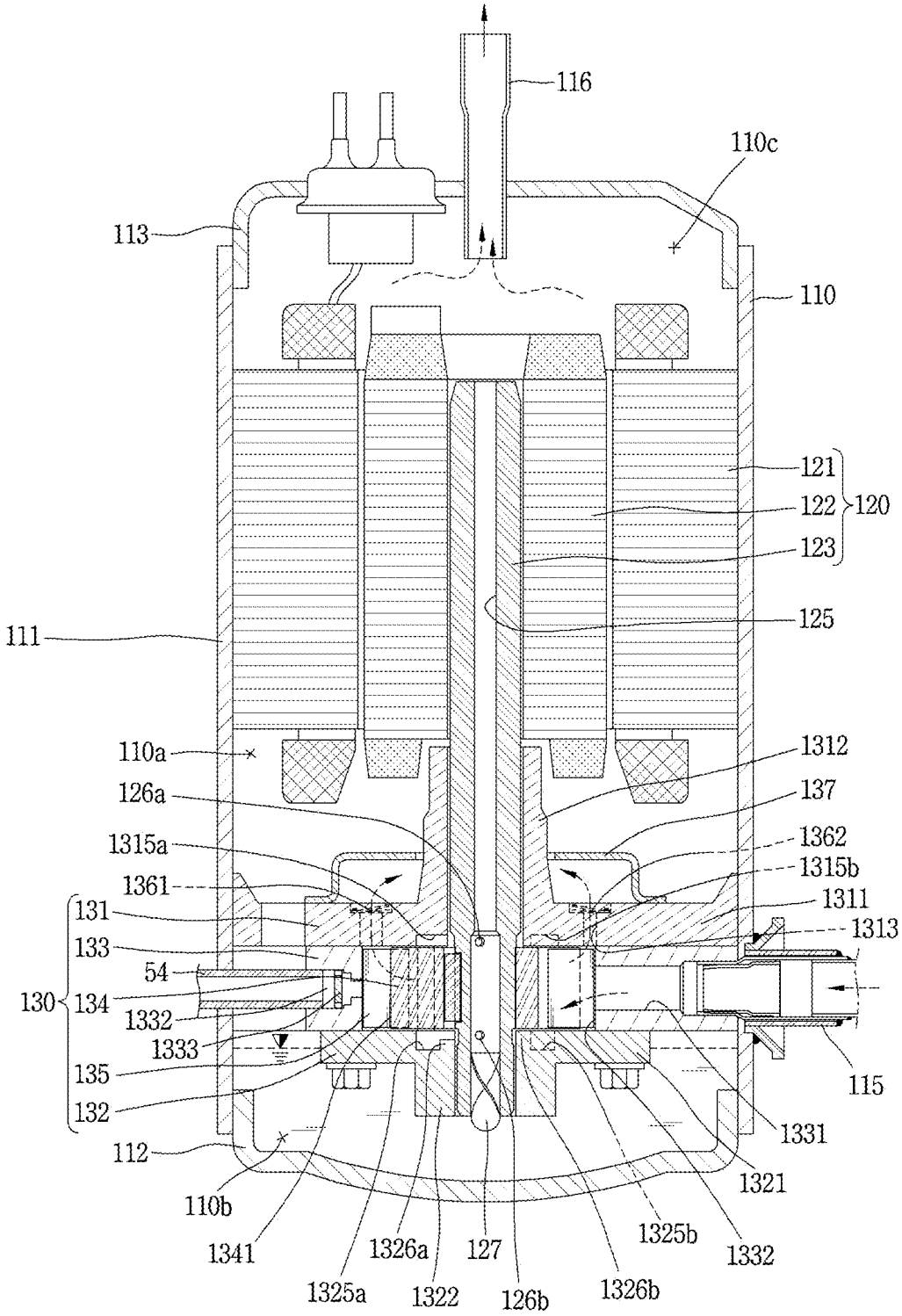
FIG. 2 is a sectional view illustrating one embodiment of a vane rotary compressor according to the present disclosure.

Referring to FIG. 2, a concentric rotary compressor according to the present embodiment includes the casing 110, a drive motor 120, and a compression part 130. The drive motor 120 is installed in an upper inner space 110*a* of the casing 110, and the compression part 130 is installed in a lower inner space 110*a* of the casing 110. The drive motor 120 and the compression part 130 are connected through a rotational shaft 123.

The casing 110 that defines an outer appearance of the compressor may be classified as a vertical type and a horizontal type according to a compressor installation method. As for the vertical type casing, the drive motor 120 and the compression part 130 are disposed at upper and lower sides in an axial direction, respectively. As for the horizontal type casing, the drive motor 120 and the compression part 130 are disposed at left and right sides, respectively. The casing according to this embodiment may be illustrated as the vertical type.

The casing 110 includes an intermediate shell 111 having a cylindrical shape, a lower shell 112 covering a lower end of the intermediate shell 111, and an upper shell 113 covering an upper end of the intermediate shell 111.

The drive motor 120 and the compression part 130 may be inserted into the intermediate shell 111 to be fixed thereto, and a suction pipe 115 may penetrate through the intermediate shell 111 to be directly connected to the compression part 130. The lower shell 112 may be coupled to the lower end of the intermediate shell 111 in a sealing manner, and an oil storage space 110*b* in which oil to be supplied to the compression part 130 is stored may be disposed below the compression part 130. The upper shell 113 may be coupled to the upper end of the intermediate shell 111 in a sealing manner, and an oil separation space 110*c* may be disposed above the drive motor 120 to separate oil from refrigerant discharged from the compression part 130.

The drive motor 120 that constitutes a motor part supplies power to cause the compression part 130 to be driven. The drive motor 120 includes a stator 121, a rotor 122, and a rotational shaft 123.

The stator 121 may be fixedly inserted into the casing 110. The stator 121 may be fixed to an inner circumferential surface of the casing 110 in a shrink-fitting manner or the like. For example, the stator 121 may be press-fitted into an inner circumferential surface of the intermediate shell 111.

The rotor 122 may be rotatably inserted into the stator 121, and the rotational shaft 123 may be press-fitted into a center of the rotor 122. Accordingly, the rotational shaft 123 rotates concentrically together with the rotor 122.

An oil flow path 125 having a hollow hole shape is located in a central portion of the rotational shaft 123, and oil passage holes 126*a* and 126*b* are disposed through a middle portion of the oil flow path 125 toward an outer circumferential surface of the rotational shaft 123. The oil passage holes 126*a* and 126*b* include a first oil passage hole 126*a* belonging to a range of a main bush portion 1312 to be described later and a second oil passage hole 126*b* belonging to a range of a sub bush portion 1322.

An oil pickup 127 may be installed in a middle or lower end of the oil flow path 125. A gear pump, a viscous pump, or a centrifugal pump may be used for the oil pickup 127. In the present embodiment, a case in which the centrifugal pump is employed is shown. Accordingly, when the rotational shaft 123 rotates, oil filled in the oil storage space 110*b* of the casing 110 is pumped by the oil pickup 127, and the oil may be sucked up along the oil flow path 125, and then, supplied to each bearing surface.

Meanwhile, the rotational shaft 123 may include a roller 134 to be described later. The roller 134 may extend integrally from the rotational shaft 123 or the rotational shaft 123 and the roller 134 that are separately manufactured may be post-assembled to each other. In this embodiment, the rotational shaft 123 is post-assembled by being inserted into the roller 134. For example, a shaft hole 1341 may be disposed through a center of the roller 134 in an axial direction and the rotational shaft 123 may be press-fitted into the shaft hole 1341 or coupled to the shaft hole 1341 to be movable in the axial direction. When the rotational shaft 123 is movably coupled to the roller 134 in the axial direction, a rotation preventing unit (not illustrated) may be provided between the rotational shaft 123 and the roller 134 so that the rotational shaft 123 can be locked with respect to the roller 134 in the circumferential direction.

The compression part 130 may include a main bearing 131, a sub bearing 132, a cylinder 133, the roller 134, and a plurality of vanes 135. The main bearing 131 and the sub bearing 132 are respectively provided at upper and lower parts of the cylinder 133 to define a compression space V together with the cylinder 133, the roller 134 is rotatably installed in the compression space V, and the vanes 135 are slidably inserted into the roller 134 to divide the compression space V into a plurality of compression chambers.

Figure 3:
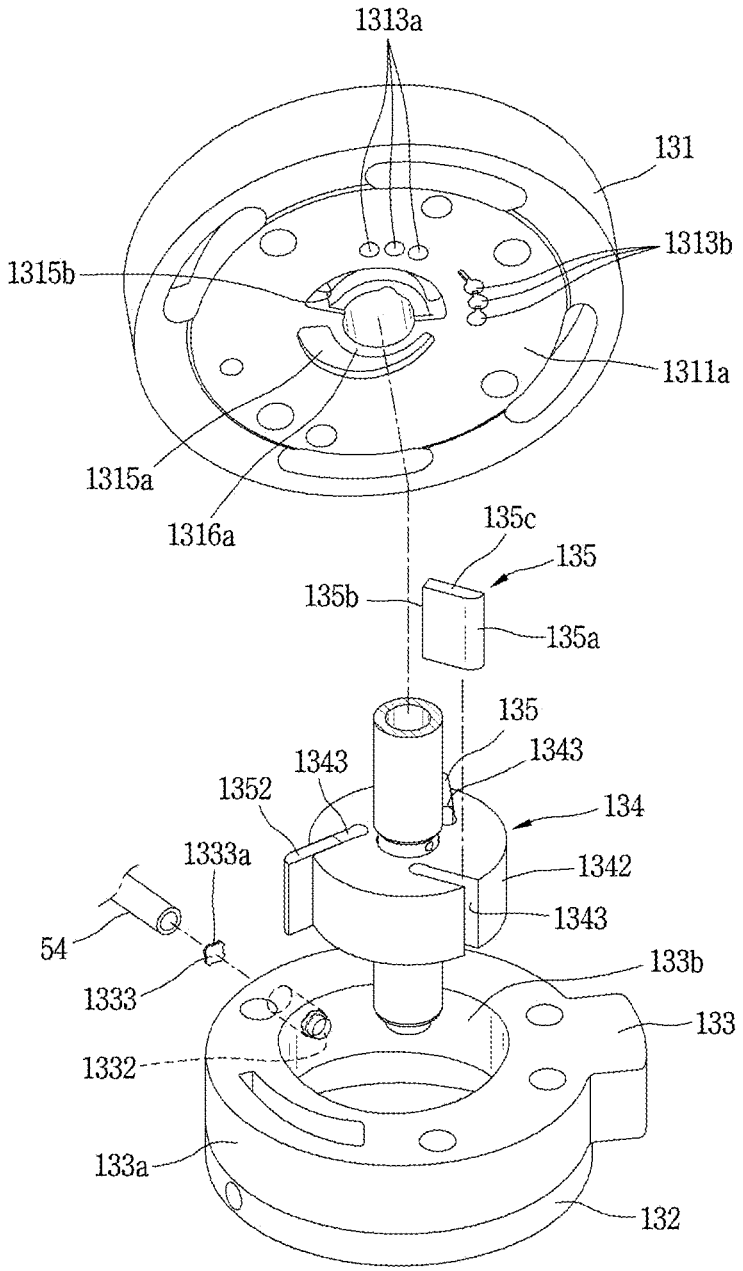
FIG. 3 is an exploded perspective view illustrating a part of a compression part of FIG. 2.

Referring to FIGS. 2 to 3, the main bearing 131 may be fixedly installed in the intermediate shell 111 of the casing 110. For example, the main bearing 131 may be inserted into the intermediate shell 111 and welded thereto.

The main bearing 131 may be coupled to an upper end of the cylinder 133 in a close contact manner. Accordingly, the main bearing 131 defines an upper surface of the compression space V, and supports an upper surface of the roller 134 in the axial direction and at the same time supports an upper half portion of the rotational shaft 123 in the radial direction.

The main bearing 131 may include a main plate portion 1311 and the main bush portion 1312. The main plate portion 1311 covers an upper part of the cylinder 133 to be coupled thereto, and the main bush portion 1312 axially extends from a center of the main plate portion 1311 toward the drive motor 120 so as to support the upper portion of the rotational shaft 123.

The main plate portion 1311 may have a disk shape, and the outer circumferential surface of the main plate portion 1311 may be fixed to the inner circumferential surface of the intermediate shell 111 in a close contact manner. Accordingly, the cylinder 133 to be described later may be easily machined or assembled.

At least one discharge port 1313*a* or 1313*b* including a first or second discharge port 1313*a* or 1313*b* may be disposed in the main plate portion 1311, and at least one discharge valve 1361 or 1362 configured to open or close the at least one discharge port 1313*a* or 1313*b*, respectively, may be disposed on an upper surface of the main plate portion 1311. Accordingly, compared to when the discharge port 1313*a* or 1313*b* is disposed in the cylinder 133, a surface pressure between the vanes 135 and the cylinder 133 near the discharge port 1313*a* or 1313*b* may be lowered, and at same time, the surface pressure may be maintained to be constant, thereby reducing vibration of the vanes 135. Thus, wear and vibration noise between a front surface 135*a* of each of the vanes 135 and/or an inner circumferential surface 133*b* of the cylinder 133 facing the front surface 135*a* may be suppressed.

A plurality of the discharge ports 1313*a* and 1313*b* may be configured as a plurality of holes disposed at a preset interval along a compression-proceeding direction (or a rotational direction of a roller). Accordingly, a discharge area can be secured as wide as possible even if a gap between the inner circumferential surface 133*b* of the cylinder 133 and the outer circumferential surface 1342 of the roller 134 is narrowed near a contact point P1.

A first main back pressure pocket 1315*a* and a second main back pressure pocket 1315*b* may be disposed in a lower surface, namely, a main sliding surface 1311*a* of the main plate portion 1311 facing the upper surface of the roller 134, of both axial side surfaces of the main plate portion 1311. A first main bearing protrusion 1316*a* may be disposed on the inner circumferential surface of the first main back pressure pocket 1315*a* at the same height as the main sliding surface 1311*a*, and the inner circumferential surface of the second main back pressure pocket 1315*b* may be open. Accordingly, the first main back pressure pocket 1315*a* may form low intermediate pressure while the second main back pressure pocket 1315*b* may form high intermediate pressure (or discharge pressure).

The main bush portion 1312 may be configured to have a hollow shape to support an upper half portion of the rotational shaft 123 in a radial direction with reference to the roller 134. Accordingly, the upper half portion of the rotational shaft 123, that is, the upper side of the roller 134, which will be described later, can be supported in the radial direction by the main bearing 131.

Referring to FIGS. 2 and 3, the sub bearing 132 may be coupled to a lower end of the cylinder 133 in a close contact manner. Accordingly, the sub bearing 132 defines a lower surface of the compression space V, and supports a lower surface of the roller 134 in the axial direction while supporting a lower-half portion of the rotational shaft 123 in the radial direction.

The sub bearing 132 may include a sub plate potion 1321 and the sub bush portion 1322. The sub plate portion 1321 covers a lower part of the cylinder 133 to be coupled to thereto, and the sub bush portion 1322 axially extends from a center of the sub plate portion 1321 toward the lower shell 112 so as to support the lower portion of the rotational shaft 123.

The sub plate portion 1321 may have a disk shape like the main plate portion 1311, and an outer circumferential surface of the sub plate portion 1321 may be spaced apart from the inner circumferential surface of the intermediate shell 111.

A first sub back pressure pocket 1325*a* and a second sub back pressure pocket 1325*b* may be disposed on an upper surface, namely, a sub sliding surface 1321*a* of the sub plate portion 1321 facing the lower surface of the roller 134, of both axial side surfaces of the sub plate portion 1321.

The first sub back pressure pocket 1325*a* and the second sub back pressure pocket 1325*b* may be symmetric to the first main back pressure pocket 1315*a* and the second main back pressure pocket 1315*b*, respectively, with respect to the roller 134. For example, the first sub back pressure pocket 1325*a* and the first main back pressure pocket 1315*a* may be symmetric to each other, and the second sub back pressure pocket 1325*b* and the second main back pressure pocket 1315*b* may be symmetric to each other.

A first sub bearing protrusion 1326*a* may be disposed on the inner circumferential side of the first sub back pressure pocket 1325*a*, and a second sub bearing protrusion 1326*b* may be disposed on the inner circumferential side of the second sub back pressure pocket 1325*b*. The first sub bearing protrusion 1326*a* may be disposed to be flush with a sub sliding surface, and the second sub bearing protrusion 1326*b* may be disposed lower than the sub sliding surface. Accordingly, the first sub back pressure pocket 1325*a* may define low intermediate pressure like the first main back pressure pocket 1315*a*, and the second sub back pressure pocket 1325*b* may define high intermediate pressure (or discharge pressure) like the second main back pressure pocket 1315*b*.

The sub bush portion 1322 may be configured to have a hollow shape to support a lower half portion of the rotational shaft 123 in a radial direction with reference to the roller 134. Accordingly, the lower half portion of the rotational shaft 123, that is, the lower side of the roller 134, which will be described later, can be supported in the radial direction by the sub bearing 132.

Referring to FIGS. 2 to 3, the cylinder 133 according to the present embodiment may be in close contact with a lower surface of the main bearing 131 and coupled to the main bearing 131 by a bolt together with the sub bearing 132. Accordingly, the cylinder 133 may be fixedly coupled to the casing 110 by the main bearing 131.

The cylinder 133 may be disposed in an annular shape having a hollow space in its center to define the compression space V. The hollow space may be sealed by the main bearing 131 and the sub bearing 132 to define the compression space V, and the roller 134 to be described later may be rotatably coupled to the compression space V.

The cylinder 133 may be provided with a suction port 1331 penetrating through an outer circumferential surface to an inner circumferential surface thereof. However, the suction port 1331 may alternatively be disposed through the main bearing 131 or the sub bearing 132. This embodiment illustrates an example in which the suction ports 1331 is disposed through the cylinder 133.

The suction port 1331 may be disposed at one side of the contact point P1 to be described later in the circumferential direction. The discharge port 1313 described above may be disposed through the main bearing 131 at another side of the contact point P1 in the circumferential direction that is opposite to the suction port 1331.

The inner circumferential surface 133*b* of the cylinder 133 may be disposed in an elliptical shape. The inner circumferential surface 133*b* of the cylinder 133 according to this embodiment may be disposed in an asymmetric elliptical shape in which a plurality of ellipses, for example, four ellipses having different major and minor ratios are combined to have two origins.

In addition, the injection passage 1332 to be described later may be disposed at one side of the suction port 1331. In other words, the injection passage 1332 through which a part of the refrigerant having passed through the condenser 20 is bypassed and re-sucked into the compression chambers V1, V2, and V3 may be disposed in the cylinder 133 through an outer circumferential surface 133*a* to an inner circumferential surface 133*b* of the cylinder 133. Accordingly, a length of the injection passage 1332 may be minimized to allow the refrigerant to be quickly injected into the compression chambers V1, V2, and V3 during an injection operation.

For example, the injection passage 1332 may be disposed at one side of the roller 134 in a rotational direction with reference to the suction port 1331. Accordingly, as an amount of a refrigerant compressed in the compression chambers V1, V2, and V3 increases, volumetric efficiency may be improved.

An injection check valve 1333 configured to open or close the injection passage 1332 may be equipped with the injection passage 1332. Various types of valves such as a plate valve, a reed valve, a ball valve, etc. may be used as the injection check valve 1333. In the present embodiment, an example in which the injection check valve 1333 is configured as a plate valve is mainly described.

Although not shown in the drawing, the injection check valve 1333 may be located outside the injection passage 1332, in other words, outside the casing 110. In this case, the injection check valve 1333 may be easily installed. The injection check valve 1333 will be described again later together with the injection passage 1332.

Referring to FIGS. 2 to 3, the roller 134 according to the present embodiment may be rotatably disposed in the compression space V of the cylinder 133, and the plurality of vanes 135 to be described later may be inserted into the roller 134 at a preset interval along a circumferential direction. Accordingly, the compression space V may be partitioned into compression chambers in correspondence with a number of the plurality of vanes 135. In this embodiment, an example in which three vanes 135 are disposed, and thus, the compression space V is partitioned into three compression chambers V1, V2, and V3 is described.

As described above, the roller 134 may extend integrally from the rotational shaft 123 or may be manufactured separately from the rotational shaft 123 and then post-assembled to the rotational shaft 123. This embodiment will be described based on an example in which the roller 134 is post-assembled to the rotational shaft 123.

A plurality of vane slots 1343 may be disposed in an outer circumferential surface of the roller 134 to cause the vanes 135 to be described later to be slidably inserted into the vane slots 1343, respectively. A plurality of back pressure chambers 1344 may be disposed on an inner circumferential surface of the roller 134 to communicate with the vane slots 1343, respectively. The plurality of back pressure chambers 1344 communicate with the first and second main and sub back pressure pockets 1315*a*, 1315*b*, 1325*a*, and 1325*b* described above, respectively, to define an intermediate pressure and/or a discharge pressure together with the first and second main and sub back pressure pockets 1315*a*, 1315*b*, 1325*a*, and 1325*b*. Accordingly, the vanes 135 inserted into the vane slots 1343, respectively, are pushed toward the inner circumferential surface 133*b* of the cylinder 133 by pressure of the back pressure chamber 1344 and pressed to thereby suppress leakage between the compression chambers V1, V2, and V3.

Also, a rotation center Or of the roller 134 is coaxially located with an axial center (no reference numeral) of the rotational shaft 123, and the roller 134 rotates concentrically with the rotational shaft 123. However, as described above, since the inner circumferential surface 133*b* of the cylinder 133 is disposed in an asymmetric elliptical shape biased in a particular direction, a rotation center of the roller 134 may be eccentrically disposed with respect to an outer diameter center of the cylinder 133. Accordingly, one side of the outer circumferential surface 1342 of the roller 134 may be almost brought into contact with the inner circumferential surface 133*b* of the cylinder 133, thereby defining the contact point P1.

Referring to FIGS. 2 and 3, the plurality of vanes 135 according to the present embodiment may be slidably inserted into the respective vane slots 1343. Accordingly, the plurality of vanes 135 may have approximately a same shape as that of the respective vane slots 1343.

The plurality of vanes 135 may have approximately a same shape. For example, the plurality of vanes 135 may each have an approximately rectangular parallelepiped shape, and front surfaces 1351*a*, 1352*a*, and 1353*a* of the vanes 135 in contact with the inner circumferential surface 133*b* of the cylinder 133 may be configured to have a curved surface in a circumferential direction. Accordingly, the front surfaces 1351*a*, 1352*a*, and 1353*a* of the vanes 135 may come into line-contact with the inner circumferential surface 133*b* of the cylinder 133, thereby reducing a friction loss.

In the drawings, an unexplained reference numeral 137 denotes a discharge muffler.

Hereinafter, an operation of a vane rotary compressor with an injection passage as described will be described.

That is, when power is applied to the drive motor 120, the rotor 122 of the drive motor 120 and the rotational shaft 123 coupled to the rotor 122 rotate together, causing the roller 134 coupled to the rotational shaft 123 or integrally disposed therewith to rotate together with the rotational shaft 123.

Then, the plurality of vanes 135 may be drawn out of the vane slots 1343, respectively, by centrifugal force generated by the rotation of the roller 134 and back pressure of the back pressure chambers 1344 which support a rear end surface 135*b* of each of the vanes 135 to be brought into contact with the inner circumferential surface 133*b* of the cylinder 133.

Then, the compression space V of the cylinder 133 may be partitioned by the plurality of vanes 135 into the compression chambers V1, V2, and V3 (including suction chambers or discharge chambers) in correspondence with the number of the vanes 135. The compression chambers V1, V2, and V3 may be changed in volume by a shape of the inner circumferential surface 133*b* of the cylinder 133 and eccentricity of the roller 134 while moving in response to the rotation of the roller 134. Accordingly, a refrigerant sucked into the respective compression chambers V1, V2, and V3 may be compressed while moving along the roller 134 and the vanes 135 to be discharged into an inner space of the casing 110. Such series of processes are repeatedly carried out.

At this time, since the injection passage 1332 connected to the outlet of the condenser 20 through the evaporation vessel 53 is disposed at one circumferential side of the suction port 1331, a part of a refrigerant having passed through the condenser 20 may be sucked back into a corresponding compression chamber V1, V2, or V3 through the injection pipe 54 and the injection passage 1332. Accordingly, as an amount of the refrigerant sucked into the corresponding compression chamber V1, V2, or V3 increases, volumetric efficiency may be improved.

In this case, the injection passage 1332 may be disposed to communicate with a compression chamber V1, V2, or V3 after a compression start angle of a compression chamber V1, V2, and V3, in other words, after a compression start angle of the corresponding compression chamber V1, V2, or V3. Accordingly, an increase in a specific volume of a suction refrigerant due to a refrigerant being injected may be suppressed.

Figure 4:
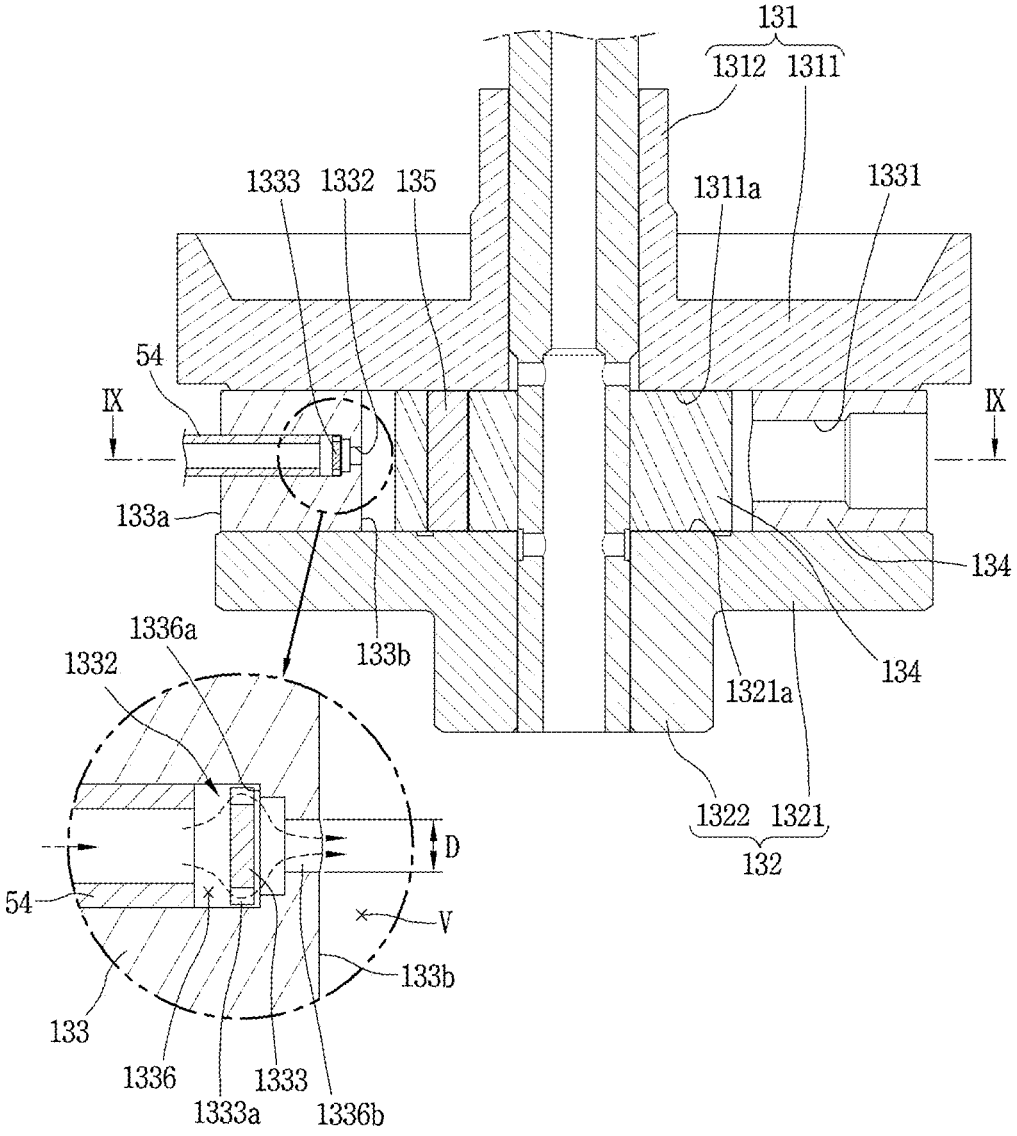
FIG. 4 is an assembled sectional view illustrating a part of a compression part in a rotary compressor according to the present embodiment.
Figure 5:
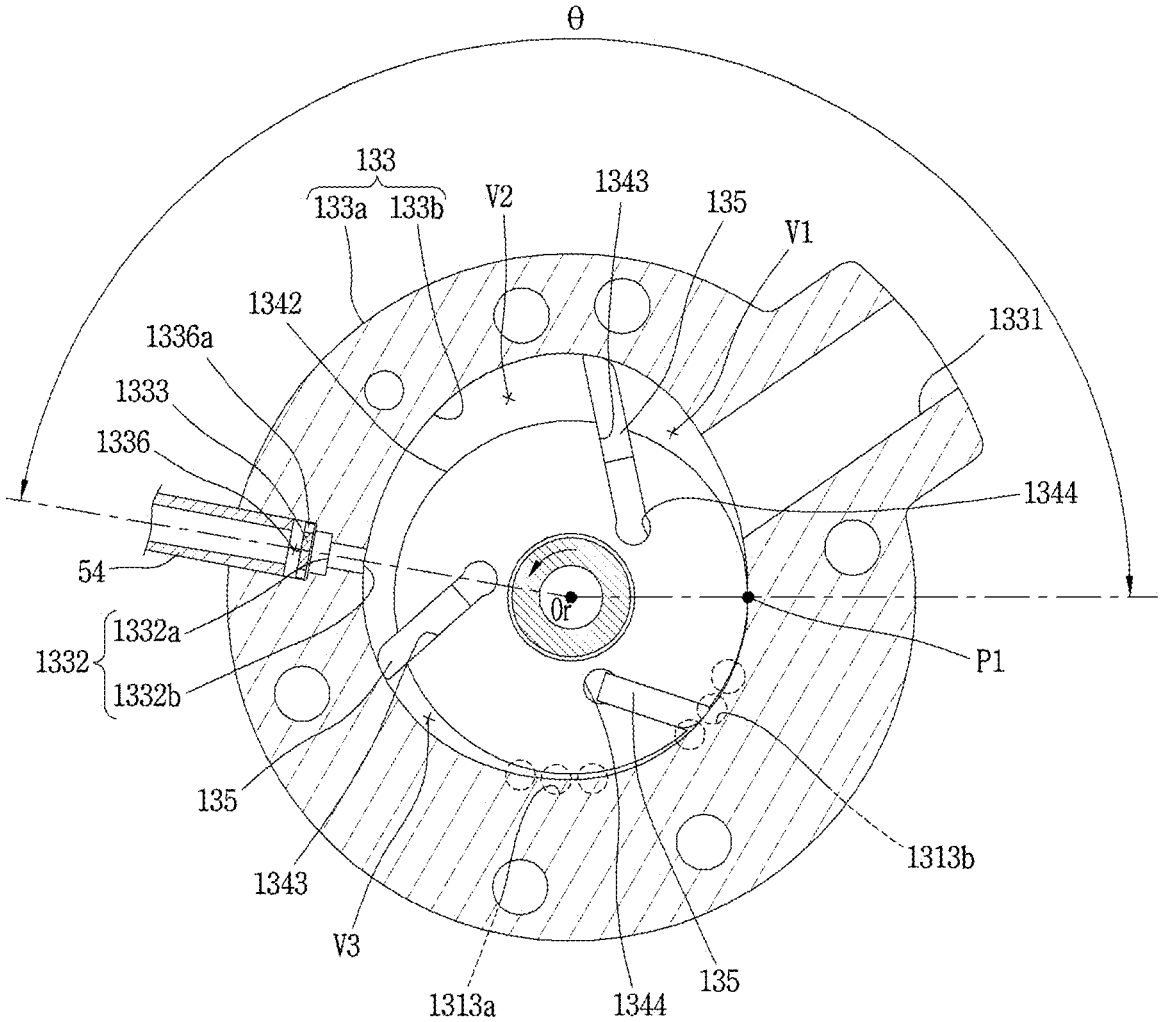
FIG. 5 is a sectional view taken along line "IX-IX" of FIG. 4.

FIG. 4 is an assembled sectional view illustrating a part of a compression part in a rotary compressor according to the present embodiment. FIG. 5 is a sectional view taken along line "IX-IX" of FIG. 4.

Referring to FIGS. 4 and 5, the injection passage 1332 may be disposed in a location such that a refrigerant being injected does not flow into the suction port 1331 (or the compression chamber in which suction is performed) while a refrigerant compressed in a corresponding compression chamber V1, V2, or V3 does not flow back toward the injection pipe 54 through the injection passage 1332. In other words, the injection passage 1332 may be disposed in a location that satisfies <Equation> shown below.

Equation $\Theta \leq$ an application area of the injection passage $\leq \theta + 360/n$, where $\theta$ is a compression start angle and n is a number of vanes.

For example, like the present embodiment, when the contact point P1 is 0° and three vanes 135 are included, the injection passage 1332 may be disposed within a range of angles greater than or equal to the compression start angle θ (approximately 170° in FIG. 5) of the corresponding compression chamber V1, V2, or V3, and less than or equal to an angle (approximately 290° in FIG. 5) obtained by adding 120° to the compression start angle θ. Accordingly, the injection passage 1332 communicates with neither a compression chamber V1, V2, or V3 in which a suction stroke is performed, nor the compression chamber V1, V2, or V3 in which a discharge stroke has been completed. Thus, a suction loss due to the refrigerant being injected may be prevented in the corresponding compression chamber V1, V2, or V3 in advance, and the refrigerant in the compression chamber V1, V2, or V3 may be suppressed from flowing back into the injection passage 1332.

In detail, a starting point of the injection passage 1332 may be located at the compression start angle θ of the corresponding compression chamber V1, V2, or V3. In other words, among both circumferential ends of the injection passage 1332, an end opposite to a rotational direction of the roller 134 may be configured to be positioned at the compression start angle θ of the corresponding compression chamber V1, V2, or V3. Accordingly, as described above, the injection passage 1332 neither communicates with a compression chamber V1, V2, or V3 in which a suction stroke is being performed, nor a compression chamber V1, V2, or V3 in which discharging has been completed, and may be located in a position farthest from the discharge port 1313 so that a longest injection section may be configured.

In addition, the injection passage 1332 according to the present embodiment may be configured such that an injection outlet 1332*b* in communication with the corresponding compression chamber V1, V2, or V3 has a circular section to be smaller than a thickness T of each of the vanes 135. However, the injection passage 1332 according to the present embodiment may be configured in association with a width T (the thickness) of the vanes 135. Generally, when a size D (e.g., an inner diameter) of the injection passage 1332 is large, compression efficiency increases during an injection operation. However, under a normal operating condition without an injection operation, the injection passage 1332 functions as a kind of dead volume, thus reducing compression efficiency. Accordingly, the inner diameter D of the injection passage 1332 (or an injection outlet) is configured to be smaller than the thickness T of each of the vanes 135 as described above, but may be increased or decreased in association with the thickness T of each of the vanes 135.

Figure 6:
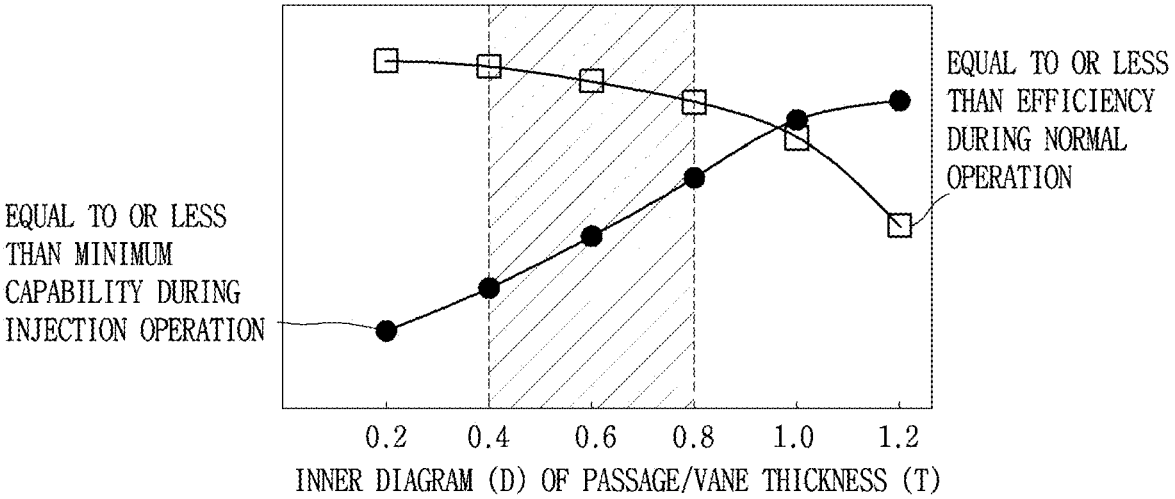
FIG. 6 is a graph showing a change in compression efficiency according to a size of an injection passage in the present embodiment.

FIG. 6 is a graph showing a change in compression efficiency according to a size of an injection passage in the present embodiment.

Referring to FIG. 6, it may be understood that when a size of the injection passage 1332, i.e., a value obtained by dividing the inner diameter D of the injection outlet 1332*b* by the thickness T of the vanes is less than 0.4, compression efficiency is greatly decreased during an injection operation, but on the contrary, when a value obtained by dividing the inner diameter D of the injection outlet 1332*b* by the thickness T of the vanes is 0.8 or more, compression efficiency is greatly decreased during a normal operation.

In other words, it may be understood that when a value obtained by dividing the inner diameter D of the injection outlet 1332*b* by the thickness T of each of the vanes is equal to or greater than 0.4 and less than or equal to 0.8, good compression efficiency is exhibited regardless of an operating condition of a compressor (an injection operation or a normal operation). Accordingly, the inner diameter D of the injection outlet 1332*b* may be desirably configured such that a value obtained by dividing the inner diameter D of the injection outlet 1332*b* by the thickness T of each of the vanes 135 is in a range from 0.4 to 0.8.

In this case, the injection passage 1332 may be desirably disposed within a preset range from the compression start angle θ, e.g., within a range of 20° after the compression start angle θ. Generally, when a position in which the injection passage 1332 communicates with the corresponding compression chamber V1, V2, or V3 with reference to a rotational direction of the roller 134 is defined as a communication position, it is advantageous to dispose the communication position to be adjacent to the compression start angle θ of the corresponding compression chamber V1, V2, or V3 as possible to secure an injection flow rate. When the injection position defined as the communication position is far away from the compression start angle θ, an injection operation may be delayed correspondingly, and thus, an injection flow rate may decrease.

Figure 7:
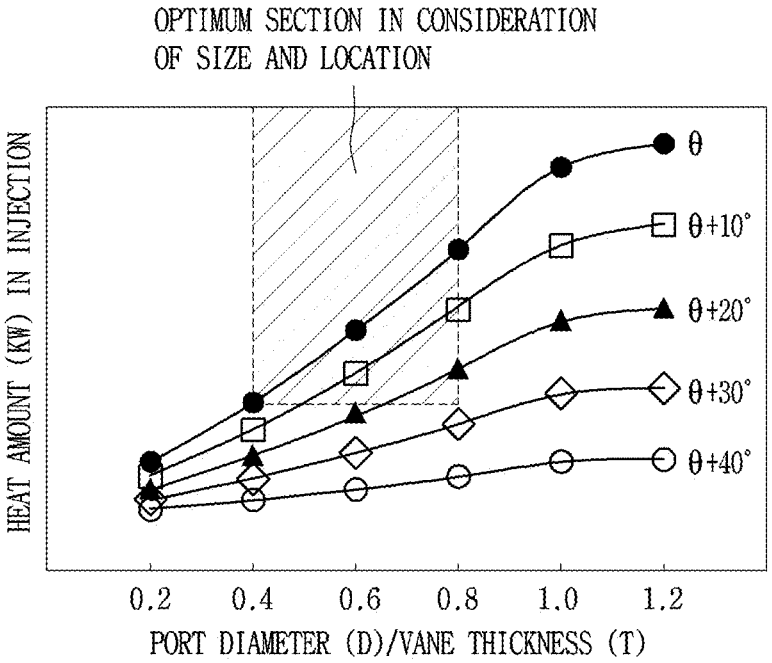
FIG. 7 is a graph showing a change in a heat amount according to a location of the injection passage in the present embodiment.

FIG. 7 is a graph showing a change in a heat amount according to a location of an injection passage in the present embodiment. This graph shows values calculated by taking into account the thickness T of the vanes 135.

Referring to FIG. 7, with reference to a case when a value obtained by dividing the inner diameter D of the injection outlet 1332*b* by the thickness T of each of the vanes 135 is in a range from 0.4 to 0.8, it may be understood that an amount of heat is highest when the injection outlet 1332*b* is disposed at the compression start angle θ, whereas an amount of heat decreases when the injection passage 1332 is away from the compression start angle θ. Particularly, it may be understood that an amount of heat is drastically reduced when the injection passage 1332 is disposed at 30° from the compression start angle θ compared to when the injection passage 1332 is disposed at 20° from the compression start angle θ. Accordingly, when a value obtained by dividing the inner diameter D of the injection outlet 1332*b* by the thickness T of the vanes 135 is in a range from 0.4 to 0.8, the injection passage 1332 may be desirably disposed at 20° from the compression start angle θ.

In addition, as described above, the injection passage 1332 according to the present embodiment may be selectively opened or closed by the injection control valves 55*a* and 55*b* disposed in a middle portion of the injection pipe 54. In other words, when an injection operation is performed, the injection passage 1332 may be opened, and when an injection operation is not performed, the injection passage 1332 may be closed. Generally, when a pressure of a refrigerant being injected is excessively high, pressure in the compression chambers V1, V2, and V3 increases excessively, thereby reducing compression efficiency. On the other hand, when pressure of the refrigerant being injected is too low, a refrigerant being compressed may flow back toward the injection portion 50. Accordingly, even when an injection operation is performed, an opening amount of the injection passage 1332 may be appropriately increased or decreased according to pressure of the compression chambers V1, V2, and V3.

Figure 8:
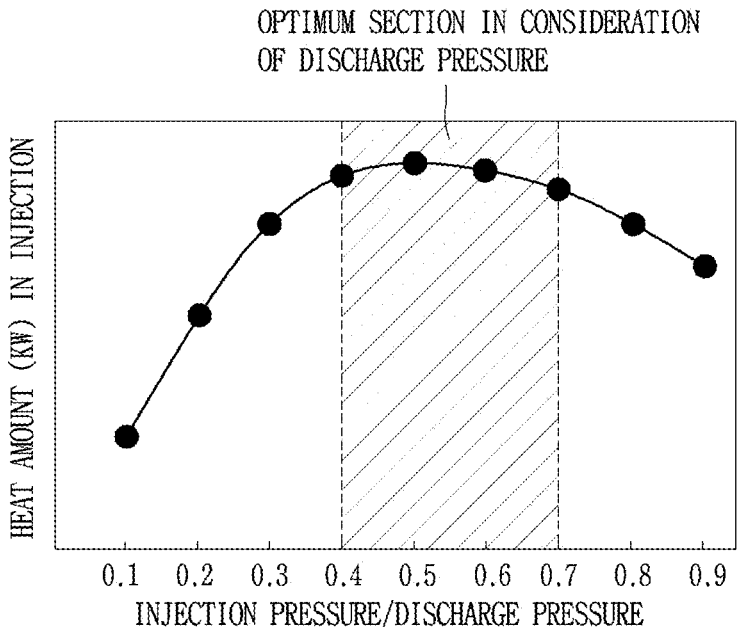
FIG. 8 is a graph showing a change in a heat amount according to an injection pressure in the present embodiment.

FIG. 8 is a graph showing a change in a heat amount according to an injection pressure in the present embodiment.

Referring to FIG. 8, it may be understood that when a value obtained by dividing an injection pressure by a discharge pressure becomes approximately 0.4, a width of increase in the amount of heat begins to rapidly slow down, and when the value becomes approximately 0.7, the amount of heat rapidly decreases. Accordingly, desirably, the first injection control valve 55*a* and/or the second injection control valve 55*b* may be controlled so that the injection pressure is approximately 0.4 to 0.7 times the discharge pressure.

As described above, when the injection passage 1332 is disposed through the cylinder 133, not only a structure of the injection passage 1332 may be simple, but also a size and/or a shape of the injection passage 1332 may be variously implemented. Accordingly, the injection passage 1332 may be easily machined, and an appropriate injection flow rate may also be easily secured.

In addition, when the injection passage 1332 is disposed through the cylinder 133, a length of the injection passage 1332 may be minimized, thereby minimizing a dead volume caused by the injection passage 1332.

Meanwhile, a valve accommodating space 1336 may be disposed in the injection passage 1332, and the injection check valve 1333 configured to open or close the injection passage 1332 by sliding due to a pressure difference may be disposed inside the valve accommodating space 1336. As described above, in the present embodiment, an example in which a plate valve is used as the injection check valve 1333 is described. However, this may apply to a case when a piston valve or a ball valve is used.

For example, a valve support surface 1336*a* configured to limit movement of the injection check valve 1333 in a closing direction may be disposed on an inner circumferential surface of the valve accommodating space 1336, and the injection pipe 54 configured to limit movement of the injection check valve 1333 in a closing direction may be disposed to be inserted at a side opposite to the valve support surface 1336*a* to have the injection check valve 1333 therebetween. In this case, a gap between the valve support surface 1336*a* and the injection pipe 54 may be configured to be larger than a thickness of the injection check valve 1333. Accordingly, the injection check valve 1333 may move inside the valve accommodating space 1336 in an opening/closing direction, for example, in a radial direction according to a pressure difference to open or close the injection passage 1332.

A plurality of injection grooves 1333*a* may be disposed in an outer circumferential surface of the injection check valve 1333, and an injection hole 1336*b* may be disposed in a center of the valve support surface 1336*a*. In this case, an inner diameter of the injection hole 1336*b* may be configured to be smaller than an inner diameter of a virtual circle connecting the injection grooves 1333*a* in the injection check valve 1333. Accordingly, the injection passage 1332 may be closed when the injection check valve 1333 is placed on the valve support surface 1336*a*.

Although not shown in the drawing, injection grooves (not shown) may be disposed along an inner circumferential surface of the valve accommodating space 1336. In this case, the injection passage 1332 may be disposed constantly while a piston valve or a ball valve is used as the injection check valve 1333.

In addition, although not shown in the drawing, an elastic member (not shown) configured to elastically support the injection check valve 1333 in a closing direction may be disposed in the valve accommodating space 1336. In this case, the injection check valve 1333 may be quickly closed during an operation of the compressor, thereby effectively suppressing a refrigerant in the compression chambers V1, V2, and V3 from flowing back into the injection passage 1332.

Figure 9:
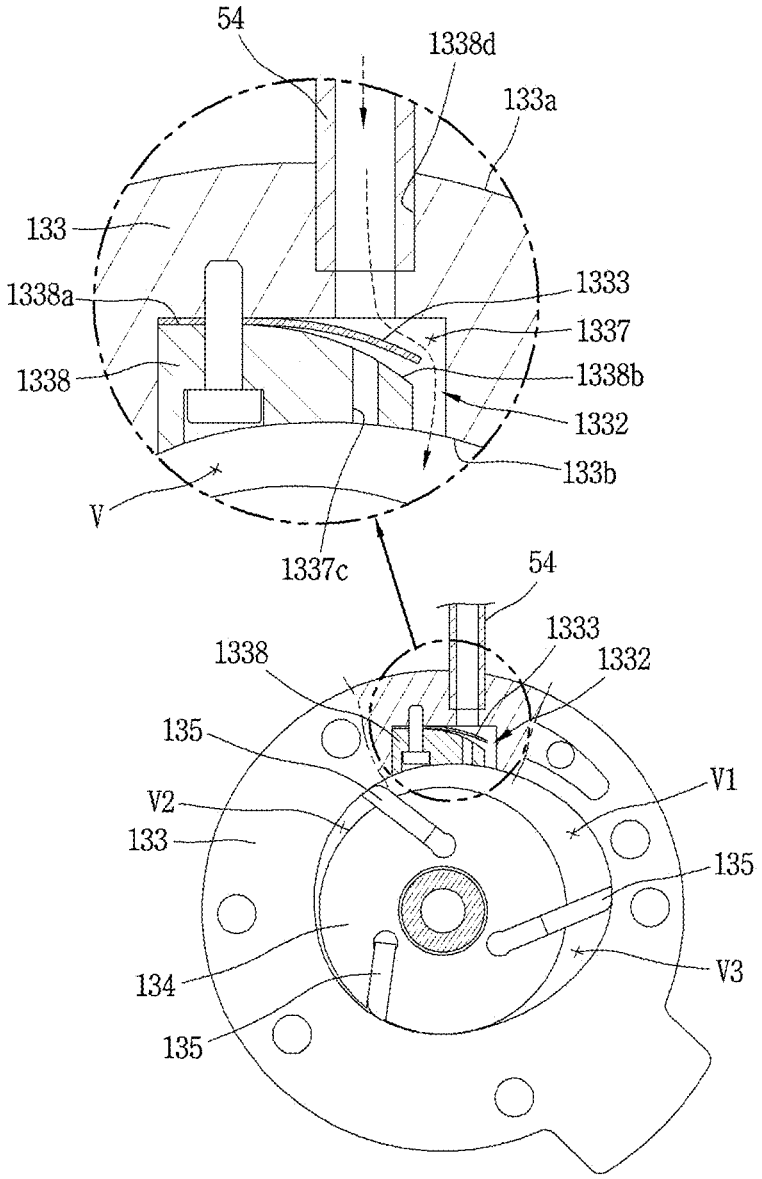
FIG. 9 is a sectional view illustrating an example in which an injection check valve configured as a reed valve is installed on an inner circumferential side of a cylinder.
Figure 10:
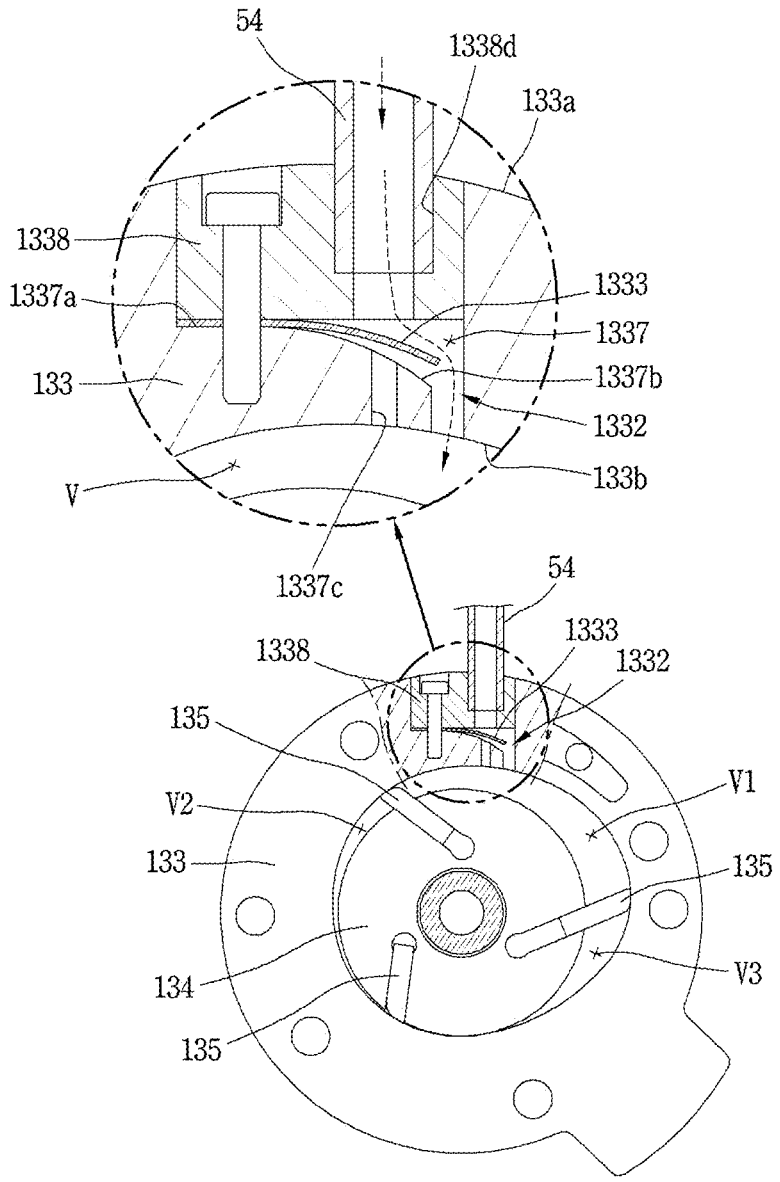
FIG. 10 is a sectional view illustrating an example in which an injection check valve configured as a reed valve is installed on an outer circumferential side of a cylinder.

Meanwhile, the injection check valve may be configured as a reed valve. FIG. 9 is a sectional view illustrating an example in which an injection check valve configured as a reed valve is installed on an inner circumferential side of a cylinder. FIG. 10 is a sectional view illustrating an example in which an injection check valve configured as a reed valve is installed on an outer circumferential side of a cylinder.

Referring to FIG. 9, a valve accommodating groove 1337 is disposed in an inner circumferential surface of the cylinder 133, and a valve support member 1338 that covers the valve accommodating groove 1337 may be fastened into the valve accommodating groove 1337. The valve accommodating groove 1337 is a space in which the injection check valve 1333 is accommodated, and the valve support member 1338 is a member configured to fix one end of the injection check valve 1333 configured as a reed valve and rotatably support another end of the injection check valve 1333. Accordingly, the injection check valve 1333 may open or close the injection passage 1332 by rotating according to a pressure difference inside the valve accommodating groove 1337.

For example, the valve accommodating groove 1337 may be recessed from the inner circumferential surface 133*b* of the cylinder 133 toward the outer circumferential surface 133*a* of the cylinder 133 by a preset depth. In this case, a sectional area of the valve accommodating groove 1337 may be configured to be larger than that of the valve support member. For example, the valve accommodating groove 1337 is configured in a rectangular shape having a length in a circumferential direction to correspond to the valve support member 1338, and an outlet of the injection passage 1332 may be disposed between an inner circumferential surface of the valve accommodating groove 1337 and an outer circumferential surface of the valve support member 1338. In other words, an axial length constituting a short axis of the valve accommodating groove 1337 may be configured to be approximately identical to an axial length of the valve support member 1338, and a circumferential length constituting a long axis of the valve accommodating groove 1337 may be configured to be greater than a circumferential length of the valve support member 1338. Accordingly, an outlet of the injection passage 1332 may be disposed at one circumferential side of the valve accommodating groove 1337 to be spaced apart from the valve support member 1338 as described above.

The valve support member 1338 may be configured in an arc shape having an inner surface with a same curvature as that of an inner circumferential surface of the cylinder 133, and having one end in close contact with a bottom surface and side wall surfaces of the valve accommodating groove 1337 with the injection check valve 1333 between the valve accommodating groove 1337 and the valve support member 1338, and another end spaced apart from the bottom surface and the side wall surfaces of the valve accommodating groove 1337. In other words, the one end of the valve support member 1338 may constitute the valve fixing surface 1338*a*, while the another end thereof may constitute the valve support surface 1338*b*. Accordingly, the injection check valve 1333 may rotate while being fixed to the valve fixing surface 1338*a* of the valve support member 1338 so that an opening amount may be limited by the valve support surface 1338*b*.

In addition, a valve pressure hole 1338*c* may be disposed in the valve support member 1338. The valve pressure hole 1338*c* may be disposed through a space between the valve support surface 1336*a* and an inner surface of the valve support surface 1336*a* constituting the inner circumferential surface 133*b* of the cylinder 133. Accordingly, when pressure inside the compression space V and/or the compression chamber V1, V2, or V3 becomes higher than pressure inside the injection pipe 54 during a compression stroke, the injection check valve 1333 may be quickly closed to thereby suppress a compression loss.

In this case, a sectional area of the valve pressure hole 1338*c* may be configured to be smaller than or equal to a sectional area of the injection passage 1332. Accordingly, dead volume due to the valve pressure hole 1338*c* may be reduced to a minimum.

Referring to FIG. 10, the valve accommodating groove 1337 is may be disposed to be recessed from the outer circumferential surface 133*a* of the cylinder 133 toward the inner circumferential surface 133*b* of the cylinder 133 by a preset depth, and the valve support member 1338 may be inserted into the valve accommodating groove 1337 to fix the injection check valve 1333. The valve accommodating groove 1337 and the valve support member 1338 in the present embodiment may be similar to the valve accommodating groove 1337 and the valve support member 1338 according to the embodiment described above with reference to FIG. 9.

However, in the present embodiment, the valve fixing surface 1337*a* may be disposed flatly at one side of the valve accommodating groove 1337, and the valve support surface 1337*b* may be disposed to be curved at another side of the valve accommodating groove 1337. In this case, an inner surface of the valve support member 1338 facing the valve support surface 1337*b* may be disposed flatly. Accordingly, in the present embodiment, the injection check valve 1333 may rotate while being fixed to the valve fixing surface 1337*a* included in the valve accommodating groove 1337 so that an opening amount may be limited by the valve support surface 1337*b*.

In addition, in the present embodiment, the injection passage 1332 may be disposed at one end of the valve accommodating groove 1337, i.e., at one side of the valve support surface 1337*b* to penetrate through the inner circumferential surface 133*b* of the cylinder 133. An injection hole 1338*d* into which the injection pipe 54 is inserted may be disposed through the valve support member 1338. Accordingly, a refrigerant having flowed into the valve accommodating groove 1337 through the injection hole 1338*d* may be injected into the compression space V through the injection passage 1332.

Additionally, in the present embodiment, the valve pressure hole 1337*c* may be disposed to penetrate between the inner circumferential surface 133*b* of the cylinder 133 and the valve support surface 1337*b* of the valve accommodating groove 1337. Accordingly, when pressure inside the compression chambers V1, V2, and V3 becomes higher than pressure inside the injection pipe 54 during a compression stroke, the injection check valve 1333 may be quickly closed to thereby suppress a compression loss.

In this case, a sectional area of the valve pressure hole 1337*c* may be configured to be smaller than or equal to a sectional area of the injection passage 1332. Accordingly, dead volume due to the valve pressure hole 1337*c* may be reduced to a minimum.

Although not shown in the drawing, the valve accommodating groove 1337 may be disposed in the main bearing 131 and/or the sub bearing 132. In other words, the valve accommodating groove 1337 may be disposed in an outer surface or an inner surface of the main bearing 131 and/or the sub bearing 132, and the injection check valve 1333 configured as a reed valve may be inserted into the valve accommodating groove 1337 and fixed by the valve support member 1338, and simultaneously, an opening amount may be limited. In these cases, the valve accommodating groove 1337 and the valve support member 1338 may be configured identically or almost identically to those in the above-described embodiments. Thus, a description thereof will not be provided here again.

Hereinafter, a description will be given of another embodiment of an injection passage.

That is, in the above-described embodiment, one injection passage is disposed as one hole, but in some cases, the injection passage may be disposed as a plurality of holes.

Figure 11:
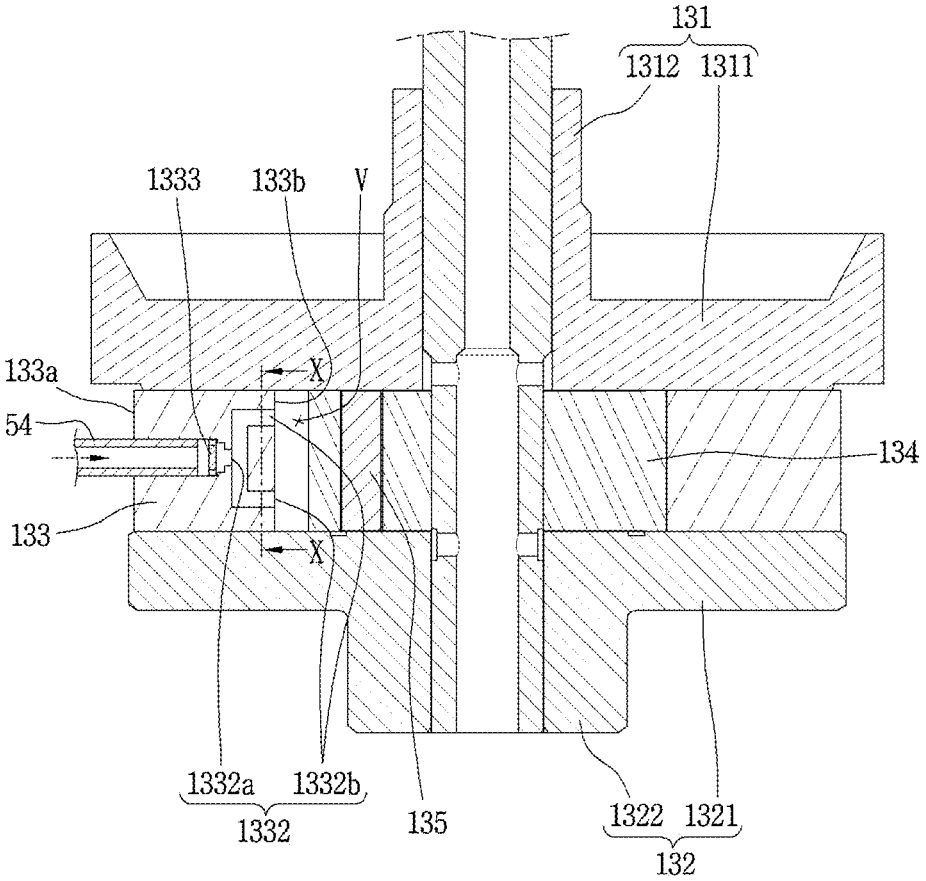
FIG. 11 is a sectional view illustrating another embodiment of the injection passage.
Figure 12:
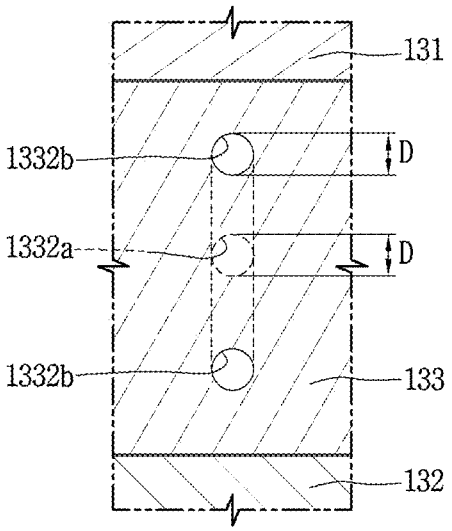
FIG. 12 is a sectional view taken along line "X-X" of FIG. 11.

FIG. 11 is a cross-sectional view illustrating another embodiment of an injection passage. FIG. 12 is a sectional view taken along line "X-X" of FIG. 11.

Referring back to FIGS. 1 and 5, basic configurations of the refrigeration cycle device 1 including the injection portion 50 and the rotary compressor 10 applied to the refrigeration cycle device 1 according to the present embodiment, and an operational effect resulting from the basic configurations are similar to those in the above-described embodiment. For example, in the cylinder 133 of the rotary compressor 10, the injection passage 1332 having a circular section is disposed through an outer circumferential surface to an inner circumferential surface of the cylinder 133, and the injection passage 1332 may be disposed near a compression start angle θ of a corresponding compression chamber V1, V2, or V3, e.g., within a range from an angle greater than the compression start angle θ to a maximum angle corresponding to a value obtained by adding, to the compression start angle θ, a result of dividing 360° by the number of vanes 135. In addition, a circumferential width D1 of the injection passage 1332 may be configured to be 0.4 to 0.8 times the thickness T of each of the vanes 135. In this case, the injection passage 1332 may be located within a range of 20° from the compression start angle θ. Thus, in addition, the injection control valves 55*a* and 55*b* may be disposed in the injection pipe 54 connected to the injection passage 1332, and the injection control valves 55*a* and 55*b* may be controlled so that a pressure of a refrigerant injected into a corresponding compression chamber V1, V2, or V3 is approximately 0.4 to 0.7 times a discharge pressure of a refrigerant discharged from the corresponding compression chamber V1, V2, or V3. A description of a location and a specification of the injection passage 1332 is replaced by a description thereof provided in the above-described embodiment.

However, in the present embodiment, an outlet of the injection passage 1332 may be branched into a plurality of holes to penetrate through an inner circumferential surface of the cylinder 133. Accordingly, a substantial size of the injection passage 1332 may be increased when conditions such as a location and a specification of the injection passage 1332 are identical to those in the above-described embodiment.

Referring to FIGS. 11 and 12, the injection passage 1332 according to the present embodiment may include one injection inlet 1332*a* and a plurality of injection outlets 1332*b*. The injection inlet 1332*a* is a portion connected to the injection pipe 54, and the injection outlets 1332*b* are portions connected to a corresponding compression chamber V1, V2 or V3.

The injection inlet 1332*a* may be disposed to be recessed from an outer circumferential surface of the cylinder 133 toward an inner circumferential surface of the cylinder 133 by a preset depth. In other words, the injection inlet 1332*a* may be disposed to be radially recessed from the outer circumferential surface 133*a* toward the inner circumferential surface 133*b* of the cylinder 133 by a preset depth. Accordingly, a length of the injection inlet 1332*a* may be minimized to increase an injection speed.

The injection outlets 1332*b* may communicate on both sides at inner ends of the injection inlet 1332*a*, and be disposed through the inner circumferential surface 133*b* of the cylinder 133 at both axial sides. In this case, the injection outlets 1332*b* may communicate by being bent at a right angle or by being inclined. In the present embodiment, an example in which the injection outlets 1332*b* communicate at the injection inlet 1332*a* at a right angle is shown.

When the plurality of injection outlets 1332*b* are present as described above, while a size D (an inner diameter) of one injection outlets 1332*b* may be configured be identical to the inner diameter D of the injection outlet 1332*b* in the above-described embodiment, but the inner diameter D of the injection outlets 1332*b* may be substantially twice the inner diameter D of the injection outlet 1332*b* in the above-described embodiment. Accordingly, an amount of a refrigerant injected into the compression space V during an injection operation may be increased to thereby improve compression efficiency.

In addition, when the plurality of injection outlets 1332*b* are present, a circumferential width of the injection outlets 1332*b* may be reduced under such a condition that a total sectional area of the injection outlets 1332*b* is identical to that in the above-described embodiment. By doing so, when a plurality of discharge ports 1313 are used, for example, a section in which the injection passage 1332 is in communication with the first discharge port 1313*a* located upstream with reference to a rotational direction of the roller 134 may be reduced. Thus, in correspondence with this, a compressed refrigerant may be effectively suppressed from flowing backward through the injection passage 1332.

In addition, when the plurality of injection outlets 1332*b* are present, in correspondence with a decrease in an area (a circumferential width) of each injection outlet 1332*b*, a starting point of the injection passage 1332 may be positioned relatively far away from the compression start angle θ. Accordingly, as a sealing distance for the injection passage 1332 is expanded, even when the front surface 135*a* of each of the vanes 135 facing an inner circumferential surface of the cylinder 133 is configured as a curved surface, a possibility of leakage in the compression chamber V1, V2, or V3 may be reduced.

Hereinafter, a description will be given of still another embodiment of an injection passage.

That is, in the above-described embodiment, an injection passage is configured to have a circular section. However, in some cases, an injection passage may be configured to have a non-circular section.

Figure 13:
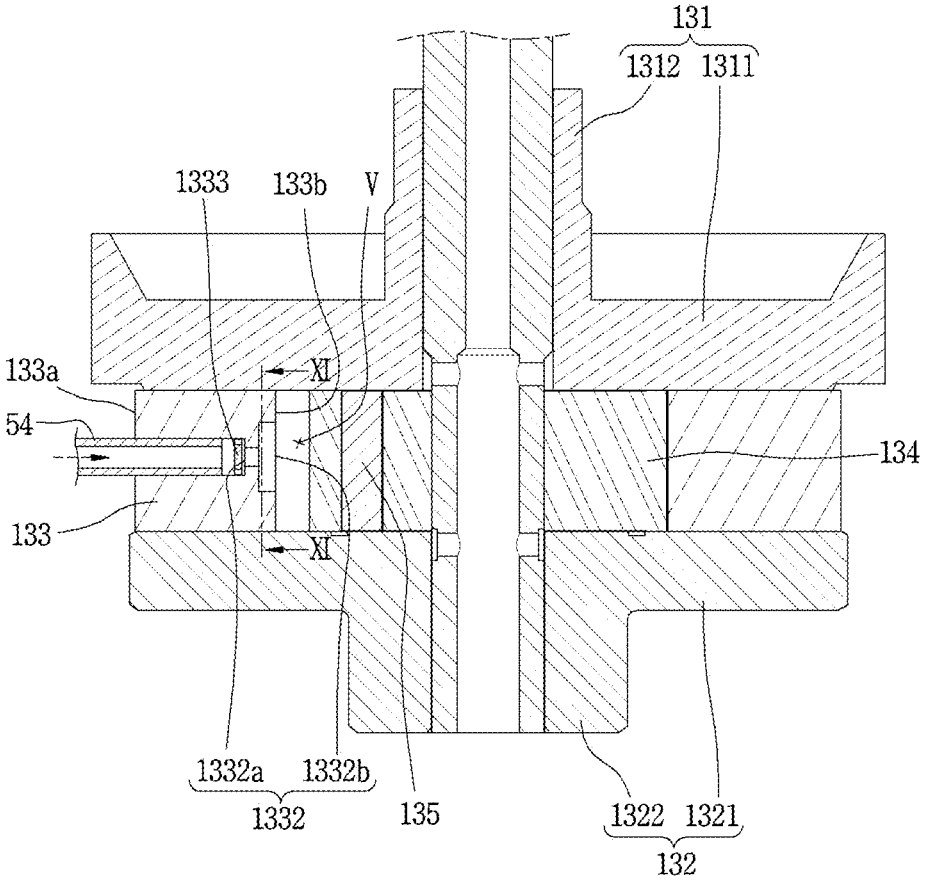
FIG. 13 is a sectional view illustrating still another embodiment of the injection passage.
Figure 14:
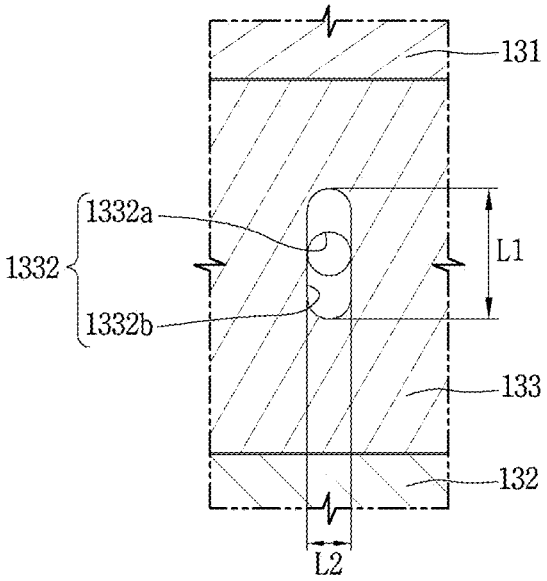
FIG. 14 is a sectional view taken along line "XI-XI" of FIG. 13.

FIG. 13 is a sectional view illustrating still another embodiment of an injection passage. FIG. 14 is a sectional view taken along line "XI-XI" of FIG. 13.

Referring back to FIGS. 1 and 5, basic configurations of the refrigeration cycle device 1 including the injection portion 50 and the rotary compressor 10 applied to the refrigeration cycle device 1 according to the present embodiment, and an operational effect resulting from the basic configurations are similar to those in the above-described embodiments. For example, in the cylinder 133 of the rotary compressor 10, the injection passage 1332 is disposed through an outer circumferential surface to an inner circumferential surface of the cylinder 133, and the injection passage 1332 may be disposed near a compression start angle θ of a corresponding compression chamber V1, V2, or V3, e.g., within a range from an angle greater than the compression start angle θ to a maximum angle corresponding to a value obtained by adding, to the compression start angle θ, a result of dividing 360° by the number of vanes 135. In addition, a circumferential width of the injection passage 1332 may be configured to be 0.4 to 0.8 times the thickness T of each of the vanes 135. In this case, the injection passage 1332 may be located within a range of 20° from the compression start angle θ. In addition, the injection control valves 55*a* and 55*b* are disposed in the injection portion 50 connected to the injection passage 1332, and the injection control valves 55*a* and 55*b* may be controlled so that a pressure of a refrigerant injected into a corresponding compression chamber V1, V2, or V3 is 0.4 to 0.7 times a discharge pressure of a refrigerant discharged from the corresponding compression chamber V1, V2, or V3. A description of a location and a specification of the injection passage 1332 is replaced by a description thereof provided with reference to the above-described embodiment.

However, in the present embodiment, the injection passage 1332 may be configured to have a non-circular section, for example, an elliptical section or a long hole shape, as shown in FIGS. 13 and 14. In other words, the injection passage 1332 may be configured to have an elliptical section or a long hole shape in which an axial length L1 is greater than a circumferential length L2. Accordingly, a substantial size of the injection passage 1332 may be increased when conditions such as a location and a specification of the injection passage 1332 are identical to those in the above-described embodiment.

As described above, when the injection passage 1332 is configured to have an axially long elliptical shape or a long hole shape, a substantial size (a sectional area) of the injection passage 1332 may be increased compared to that in the above-described embodiment. Accordingly, a flow rate of a refrigerant injected into the compression chamber V1, V2 or V3 during an injection operation may be increased to thereby improve compression efficiency.

In addition, when the injection passage 1332 is configured to have an axially long elliptical or long hole shape, a circumferential width of the injection passage 1332 may be reduced while a total sectional area of the injection passage 1332 is maintained identically. By doing so, when the plurality of discharge ports 1313 are used, for example, a section in which the injection passage 1332 is in communication with the first discharge port 1313*a* located upstream with reference to a rotational direction of the roller 134 may be reduced. Thus, in correspondence with this, a compressed refrigerant may be effectively suppressed from flowing backward through the injection passage 1332.

In addition, when the injection passage 1332 is configured to have an axially long elliptical or long hole shape, in correspondence with a decrease in a circumferential width of the injection passage 1332*b*, a starting point of the injection passage 1332 may be positioned relatively far away from the compression start angle θ. Accordingly, as a sealing distance for the injection passage 1332 is expanded, even when the front surface 135*a* of each of the vanes 135 facing an inner circumferential surface of the cylinder 133 is configured as a curved surface, a possibility of leakage between the compression chambers V1, V2, and V3 may be reduced.

Hereinafter, a description will be given of still another embodiment of an injection passage.

That is, in the above-described embodiment, an injection passage is disposed in a cylinder. However, in some cases, an injection passage may be disposed in a main bearing.

Figure 15:
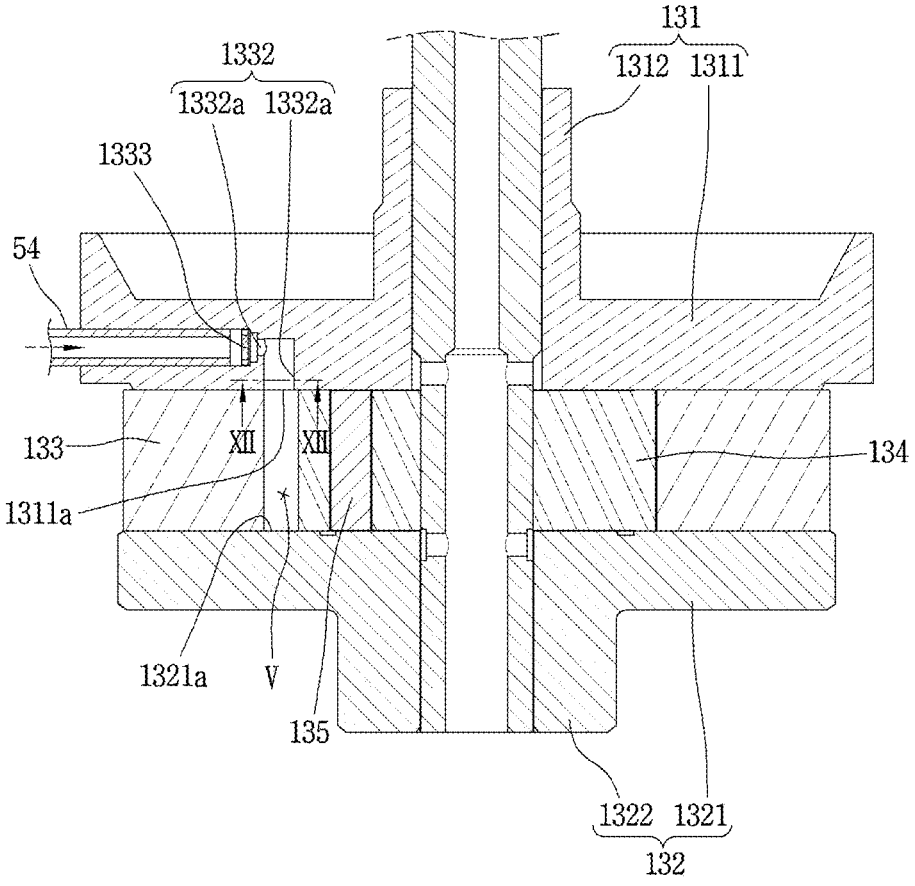
FIG. 15 is a sectional view illustrating still another embodiment of the injection passage.
Figure 16:
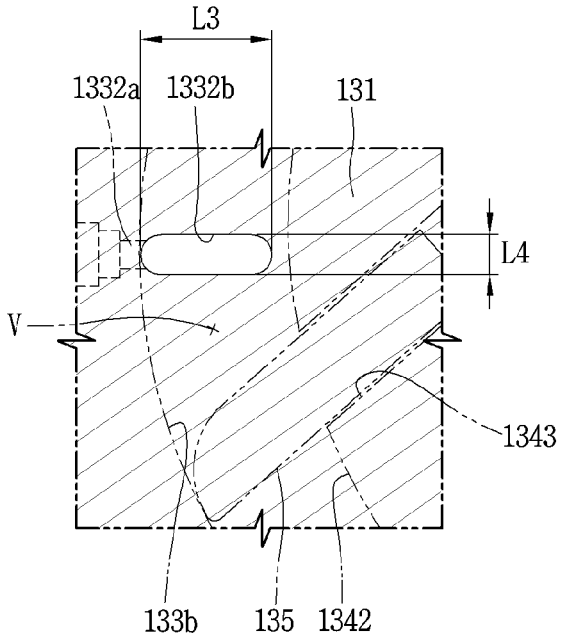
FIGS. 16 and 17 are sectional views taken along line "XII-XII" of FIG. 15.
Figure 17:
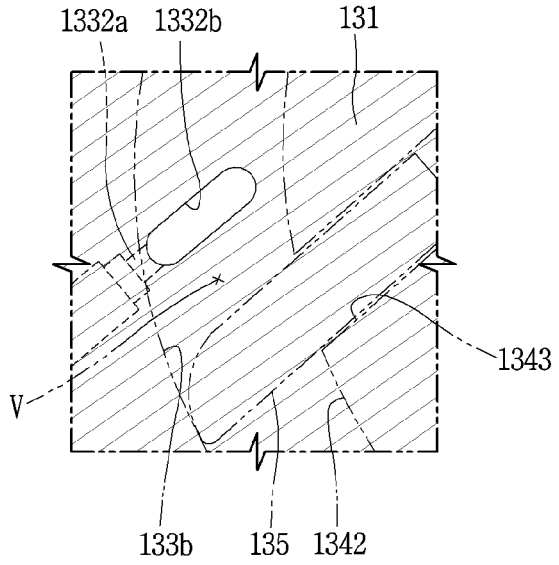

FIG. 15 is a cross-sectional view illustrating still another embodiment of an injection passage. FIGS. 16 and 17 are sectional views taken along line "XII-XII" of FIG. 15.

Referring back to FIGS. 1 and 5, basic configurations of the refrigeration cycle device 1 including the injection portion 50 and the rotary compressor 10 applied to the refrigeration cycle device 1 according to the present embodiment, and an operational effect resulting from the basic configurations are similar to those in the above-described embodiment. For example, in the rotary compressor 10, the injection passage 1332 may be disposed near a compression start angle θ of a corresponding compression chamber V1, V2, or V3, e.g., within a range from an angle greater than the compression start angle θ to a maximum angle corresponding to a value obtained by adding, to the compression start angle θ, a result of dividing 360° by the number of vanes 135. In addition, a circumferential width D1 of the injection passage 1332 may be configured to be 0.4 to 0.8 times the thickness T of each of the vanes 135. Thus, in this case, the injection passage 1332 may be located within a range of 20° from the compression start angle θ. In addition, the injection control valves 55*a* and 55*b* may be disposed in the injection portion 50 connected to the injection passage 1332, and the injection control valves 55*a* and 55*b* may be controlled so that a pressure of a refrigerant injected into a corresponding compression chamber V1, V2, or V3 is 0.4 to 0.7 times a discharge pressure of a refrigerant discharged from the corresponding compression chamber V1, V2, or V3. A description of a location and a specification of the injection passage 1332 is replaced by a description thereof provided with reference to the above-described embodiment.

However, in the present embodiment, the injection passage 1332 may be disposed through the main bearing 131. For example, the injection passage 1332 may include the injection inlet 1332*a* and the injection outlet 1332*b*. The injection inlet 1332*a* is a portion connected to the injection pipe 54, and the injection outlet is a portion connected to the compression space V.

Referring to FIGS. 15 to 17, the injection inlet 1332*a* according to the present embodiment may be recessed by a preset depth from an outer circumferential surface of the main bearing 131 toward an inner circumferential surface of the main bearing 131, and the injection outlet 1332*b* may communicate with the injection inlet 1332*a* to penetrate through the main sliding surface 1311*a* toward the compression chambers V1, V2, and V3. In other words, the injection inlet 1332*a* may be disposed in a radial direction, and the injection outlet 1332*b* may be disposed in an axial direction by being bent at an inner end of the injection inlet 1332*a*. Accordingly, the injection inlet 1332*a* comes into contact with an inner circumferential surface of the casing 110 to easily couple the injection pipe 54 into the injection passage 1332, while tightly sealing a space between the injection passage 1332 and the injection pipe 54.

In addition, in this case, the injection outlet 1332*b* may be configured to have a circular shape or non-circular shape. When the injection outlet 1332*b* is configured to have a circular shape, machining may be easily performed. However, as shown in FIG. 16, the injection outlet 1332*b* may be configured to have a non-circular shape, e.g., the injection outlet 1332*b* may have a radial length L3 greater than a circumferential length L4. Accordingly, a substantial size of the injection outlet 1332*b* in communication with the compression chambers V1, V2, and V3 may be increased when conditions such as a location and a specification of the injection passage 1332 are identical.

Additionally, in this case, the injection outlet 1332*b* may extend in an axial direction or extend in a direction inclined with respect to the axial direction. When the injection outlet 1332*b* extends in the axial direction, the injection passage 1332 may be easily machined, and a length of the injection passage 1332 may be minimized. However, as shown in FIG. 17, the injection outlet 1332*b* may be disposed to extend to have a length in a direction toward which the vanes 135 are inclined. In other words, the vanes 135 may be disposed to be inclined at a preset angle with respect to a radial direction with reference to a rotation center of rotation of the roller 134 when projected in an axial direction, and the injection outlet 1332*b* may be disposed to be inclined at a same angle as an angle at which the vanes 135 are inclined with respect to the radial direction when projected in an axial direction. Accordingly, a substantial size of the injection outlet 1332*b* in communication with the compression chambers V1, V2, and V3 may be increased when conditions such as a location and a specification of the injection passage 1332 are identical.

As described above, when the injection passage 1332 is disposed in the main bearing 131, a refrigerant being injected presses an axial side surface of the vanes 135 physically supported by the sub bearing 132. Thus, a reciprocating motion of the vanes 135 is not greatly affected. Accordingly, behavior of the vanes 135 becomes stable during an injection operation, and performance of a compressor may be improved.

In addition, when the injection passage 1332 is disposed in the main bearing 131, a large bearing area may be secured between the front surface 135*a* of each of the vanes 135 and the inner surface 133*a* of the cylinder 133 facing the front surface 135*a*. This may prevent an increase in a surface pressure between the vanes 135 and the cylinder 133, thereby improving reliability.

In addition, when the injection passage 1332 is disposed in the main bearing 131, as an axial side surface 135*c* of each of the vanes 135 is configured as a plane, a large sealing area may be secured, and a contact state between the vanes 135 and the main bearing 131 may be continuously maintained. Accordingly, compared to a cylinder injection structure as in the above-described embodiments, leakage between the compression chambers V1, V2, and V3 may be effectively suppressed.

Although not shown in the drawing, the injection passage 1332 may be disposed to be inclined from an outer circumferential surface of the main bearing 131 toward the main sliding surface 1311*a*, or may be disposed through the main plate portion 1311 of the main bearing 131 in an axial direction. In these cases, the injection passage 1332 may be configured as a straight line, thus simplifying machining correspondingly.

Hereinafter, a description will be given of still another embodiment of an injection passage.

That is, an injection passage is disposed in a main bearing in the above-described embodiment. However, in some cases, an injection passage may be disposed in a sub bearing.

Figure 18:
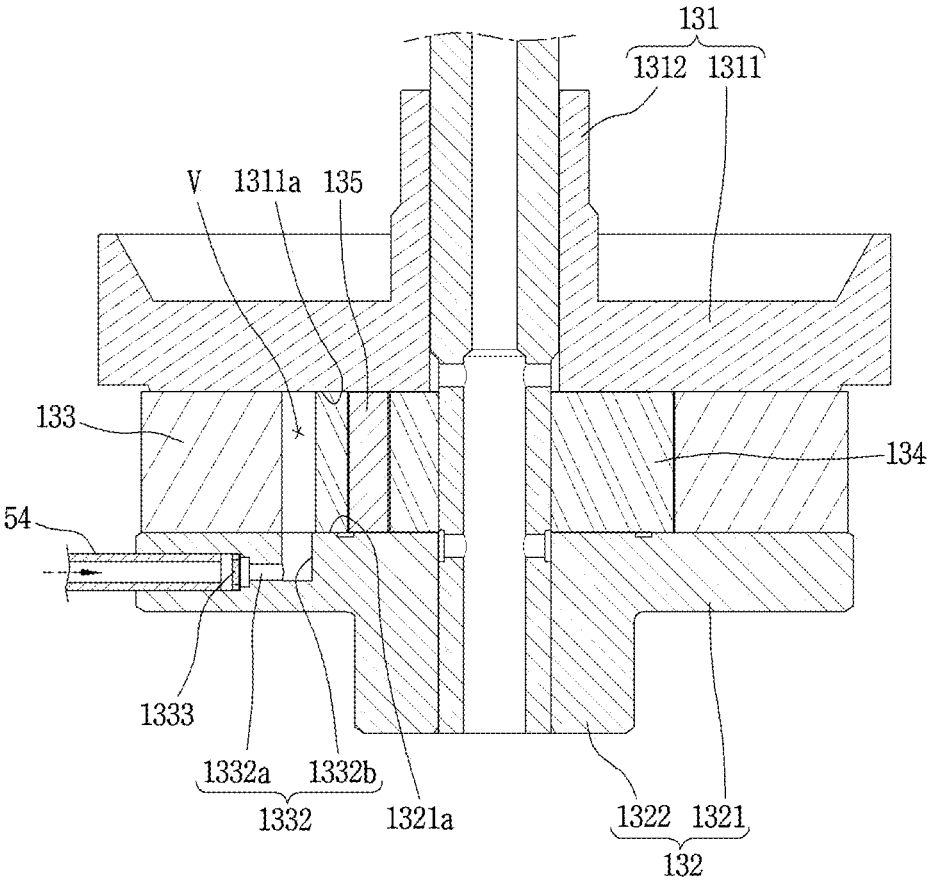
FIGS. 18 and 19 are sectional views illustrating still another embodiment of the injection passage.
Figure 19:
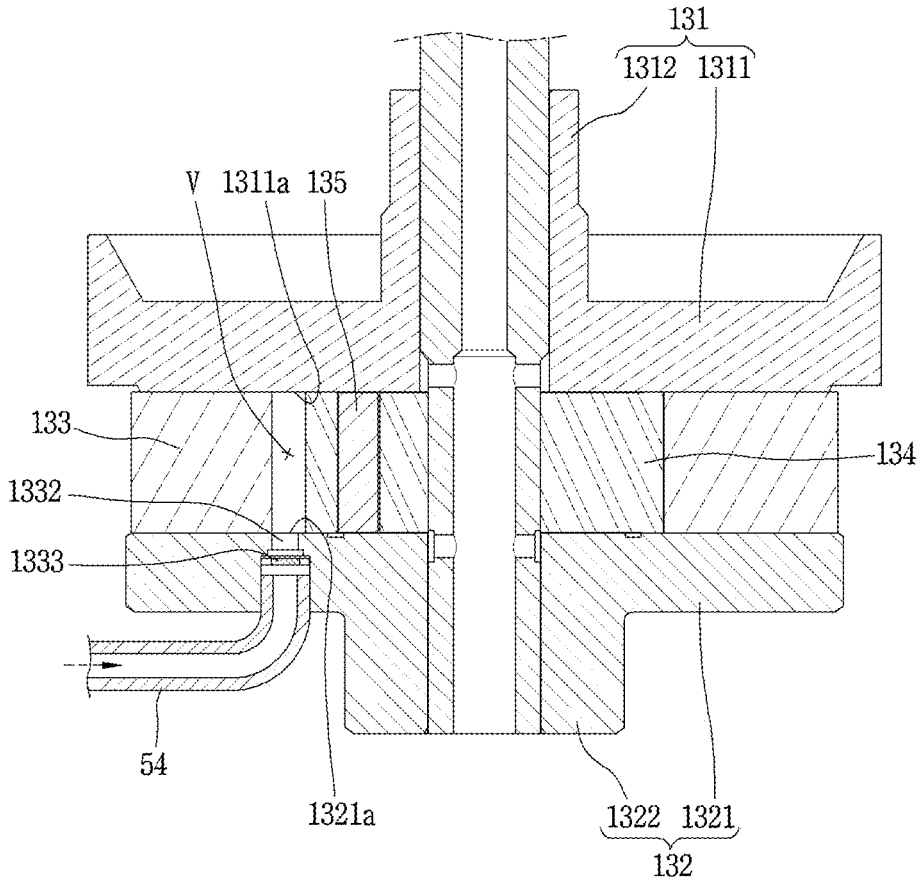

FIGS. 18 and 19 are sectional views illustrating still other embodiments of an injection passage Referring back to FIGS. 1 and 5, basic configurations of the refrigeration cycle device 1 including the injection portion 50 and the rotary compressor 10 applied to the refrigeration cycle device 1 according to the present embodiment, and an operational effect resulting from the basic configurations are similar to those in the above-described embodiment. For example, in the rotary compressor 10, the injection passage 1332 may be disposed near a compression start angle θ of a corresponding compression chamber V1, V2, or V3, e.g., within a range from an angle greater than the compression start angle θ to a maximum angle corresponding to a value obtained by adding, to the compression start angle θ, a result of dividing 360° by the number of vanes 135. In addition, a circumferential width D1 of the injection passage 1332 may be configured to be 0.4 to 0.8 times the thickness T of each of the vanes 135. In this case, the injection passage 1332 may be located within a range of 20° from the compression start angle θ In addition, the injection control valves 55*a* and 55*b* may be disposed in the injection portion 50 connected to the injection passage 1332, and the injection control valves 55*a* and 55*b* may be controlled so that a pressure of a refrigerant injected into a corresponding compression chamber V1, V2, or V3 is 0.4 to 0.7 times a discharge pressure of a refrigerant discharged from the corresponding compression chamber V1, V2, or V3. A description of a location and a specification of the injection passage 1332 is replaced by a description thereof provided with reference to the above-described embodiment.

However, in the present embodiment, the injection passage 1332 may be disposed through the sub bearing 132. For example, the injection passage 1332 may include the injection inlet 1332*a* and the injection outlet 1332*b*. The injection inlet 1332*a* is a portion connected to the injection pipe 54, and the injection outlet 1332*b* is a portion connected to the compression space V.

Referring to FIG. 18, the injection inlet 1332*a* according to the present embodiment may be recessed by a preset depth from an outer circumferential surface of the sub bearing 132 toward an inner circumferential surface of the sub bearing 132, and the injection outlet 1332*b* may communicate with the injection inlet 1332*a* to penetrate through the sub sliding surface 1321*a* toward the compression space V., In other words, the injection inlet 1332*a* may be disposed in a radial direction, and the injection outlet 1332*b* may be disposed in an axial direction by being bent at an inner end of the injection inlet 1332*a*.

Additionally, in this case, the injection outlet 1332*b* may be configured to have a circular shape or a long hole shape having a length in a radial direction, or disposed in a radial direction or disposed to be inclined with respect to a radial direction to correspond to the vanes 135.

As described above, even when the injection passage 1332 is disposed in the sub bearing 132, an operational effect thereof is similar to that of a case when the injection passage 1332 is disposed in the main bearing 131 like the embodiment described with reference to FIG. 15. Thus, a description thereof is replaced by the description of the embodiment provided with reference to FIG. 15.

However, since the sub bearing 132 has a structure simpler than that of the main bearing 131 in which the first and second discharge ports 1313*a* and 1313*b* are disposed, a space for defining the injection passage 1332 may be easily secured, and a space for connecting the injection pipe 54 to the injection passage 1332 may be also easily secured. Accordingly, compared to a case when the injection passage 1332 is disposed in the main bearing 131, the injection passage 1332 may be easily machined, and the injection pipe 54 may easily connected to the injection passage 1332.

Additionally, referring to FIG. 19, the injection passage 1332 may be disposed in the sub bearing 132 to penetrate through both axial side surfaces of the sub bearing 132. In this case, the injection pipe 54 may radially penetrate through the casing 110 to be axially bent inside the casing 110. For example, the injection pipe 54 may be bent in a curved line and inserted into the injection passage 1332. Accordingly, the injection passage 1332 may be minimized to easily machine the injection passage 1332.

In addition, when the injection passage 1332 is axially disposed in the sub bearing 132, the injection pipe 54 inside the casing 110 may be immersed in oil stored inside the casing 110. Accordingly, the injection pipe 54 may be heated, and thus, some of a liquid refrigerant injected through the injection pipe 54 may evaporate, thereby reducing a flow of the liquid refrigerant into the compression space V.

Hereinafter, a description will be given of still another embodiment of an injection passage.

That is, in some embodiments described above, an injection passage is disposed in one selected from a cylinder, a main bearing, and a sub bearing. However, in some cases, an injection passage may be disposed in both a main bearing and a sub bearing.

Figure 20:
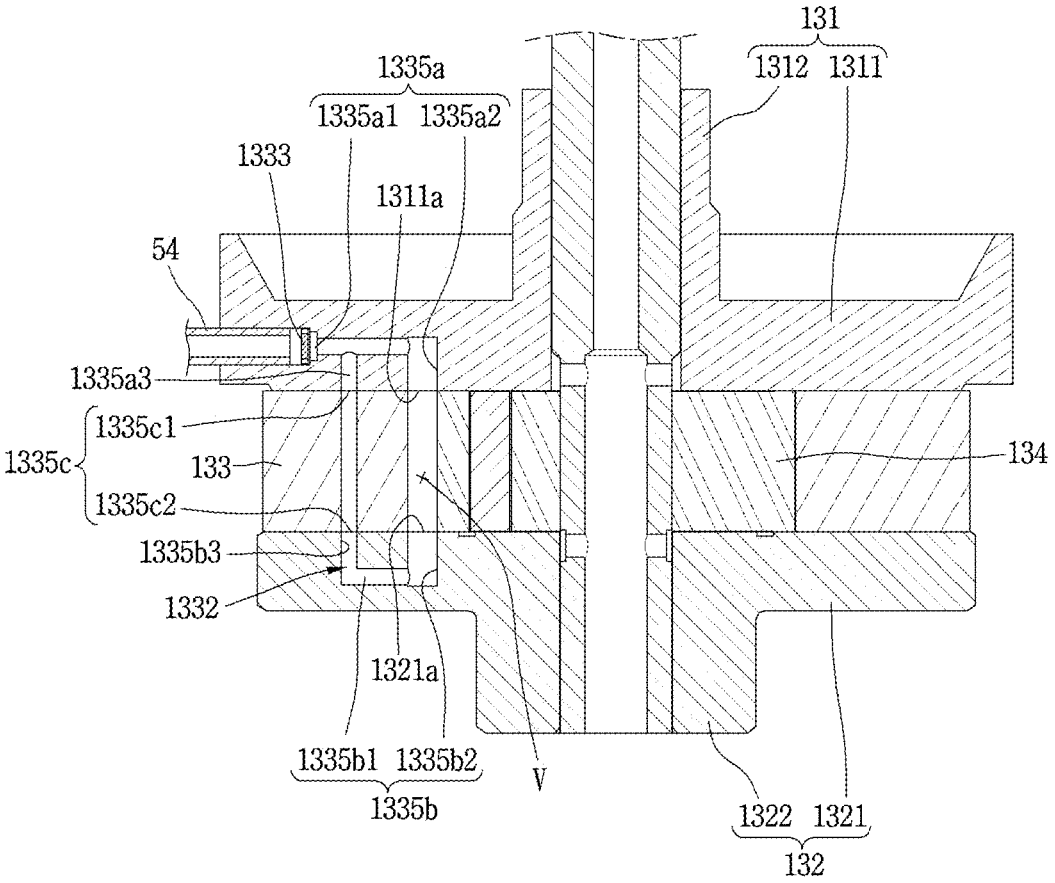
FIG. 20 is a sectional view illustrating still another embodiment of the injection passage.

FIG. 20 is a sectional view illustrating still another embodiment of an injection passage.

Referring back to FIGS. 1 and 5, basic configurations of the refrigeration cycle device 1 including the injection portion 50 and the rotary compressor 10 applied to the refrigeration cycle device 1 according to the present embodiment, and an operational effect resulting from the basic configurations are similar to those in the above-described embodiments. For example, in the rotary compressor 10, the injection passage 1332 may be disposed near a compression start angle θ of a corresponding compression chamber V1, V2, or V3, e.g., within a range from an angle greater than the compression start angle θ to a maximum angle corresponding to a value obtained by adding, to the compression start angle θ, a result of dividing 360° by the number of vanes 135. In addition, a circumferential width D1 of the injection passage 1332 is configured to be 0.4 to 0.8 times the thickness T of each of the vanes 135. In this case, the injection passage 1332 may be located within a range of 20° from the compression start angle θ. In addition, the injection control valves 55*a* and 55*b* are disposed in the injection portion 50 connected to the injection passage 1332, and the injection control valves 55*a* and 55*b* may be controlled so that a pressure of a refrigerant injected into the corresponding compression chamber V1, V2, and V3 is 0.4 to 0.7 times a discharge pressure of the refrigerant discharged from the corresponding compression chamber V1, V2, or V3. A description of a location and a specification of the injection passage 1332 is replaced by a description thereof provided with reference to the above-described embodiments.

However, in the present embodiment, the injection passage 1332 may be disposed through the main bearing 131 and the main bearing 132 as shown in FIG. 20. For example, the injection passage 1332 may include a first injection passage 1335*a* and a second injection passage 1335*b*. The first injection passage 1335*a* is disposed through the main bearing 131, and the second injection passage 1335*b* is disposed through the sub bearing 132. In this case, the first injection passage 1335*a* and the second injection passage 1335*b* may be configured to be connected to each other or may be disposed independently. In the present embodiment, an example in which the first injection passage 1335*a* and the second injection passage 1335*b* are configured to be connected to each other is shown.

In detail, the first injection passage 1335*a* may be connected to the injection pipe 54, and the second injection passage 1335*b* may be connected in a middle portion of the first injection passage 1335*a*. In other words, the first injection passage 1335*a* and the second injection passage 1335*b* may be connected to each other through an injection connection passage 1335*c*. In this case, the injection connection passage 1335*c* may be disposed through inside of the cylinder 133 or disposed to be exposed to outside of the cylinder 133. In a former case, the injection passage 1332 may be stably sealed, and in a latter case, a great thickness of the cylinder 133 may be secured to suppress deformation of the cylinder 133. In the present embodiment, an example in which the injection connection passage 1335*c* is disposed through inside of the cylinder 133.

For example, the first injection passage 1335*a* may include a first injection inlet 1335*a*1 recessed radially from an outer circumferential surface of the main bearing 131. and a first injection outlet 1335*a*2 that penetrates from the first injection inlet 1335*a*1 through the main sliding surface 1311*a*. Accordingly, a sealing area between the main bearing 131 and the cylinder 133 may be secured, and simultaneously, the injection pipe 54 may be easily inserted and connected into the first injection inlet 1335*a*1.

Although not shown in the drawing, the first injection passage 1335*a* may be recessed by a preset depth from one side surface of the main bearing 131 facing one side surface of the cylinder 133 to extend in a radial direction. In this case, since the first injection passage 1335*a* is disposed radially to the compression space V without being bent, the first injection passage 1335*a* may be easily disposed.

The second injection passage 1335*b* may include a second injection inlet 1335*b*1 recessed from one axial side surface of the sub bearing 132 toward an inner circumferential surface of the sub bearing 132, and a second injection outlet 1335*b*2 that penetrates from the second injection inlet 1335*b*1 through a sub-sliding surface 1321*a*. Thus, a sealing area between the cylinder block 132 and the cylinder 133 may be secured.

Although not shown in the drawing, the second injection passage 1335*b* may be recessed by a preset depth from one side surface of the sub bearing 132 facing another side surface of the cylinder 133 to extend in a radial direction. In this case, since the second injection passage 1335*b* is disposed radially to the compression space V without being bent, the second injection passage 1335*b* may be easily disposed.

The injection connection passage 1335*c* may penetrate through a space between one axial side surface of the cylinder 133 facing the main bearing 131 and another axial side surface of the cylinder 133 facing the sub bearing 132, and a first end 1335*c*1 of the injection connection passage 1335*c* may be disposed to communicate with a middle portion of the first injection passage 1335*a*, and a second end 1335*c*2 of the injection connection passage 1335*c* may be disposed to communicate with a middle portion or an outer end of the second injection passage 1335*b*. In other words, a first branch passage 1335*a*3 that opens toward one side surface of the cylinder 133 may be disposed in a middle portion of the first injection passage 1335*a*, a second branch passage 1335*b*3 that opens toward another side surface of the cylinder 133 may be disposed in a middle portion or an outer end of the second injection passage 1335*b*, and both ends of the injection connection passage 1335*c* may be connected to the first branch passage 1335*a*3 and the second branch passage 1335*b*3, respectively. Accordingly, a part of a refrigerant having flowed into the first injection passage 1335*a* through the injection pipe 54 may move to the second injection passage 1335*b* through the injection connection passage 1335*c* to be sucked into the compression chambers V1, V2, and V3, respectively. Thus, since a whole area of the injection passage 1332 is enlarged, an injection effect may be enhanced.

What is claimed is:

1. A rotary compressor, comprising:

a casing;

a main bearing and a sub bearing each disposed in an inner space of the casing;

a cylinder disposed between the main bearing and the sub bearing to define a compression space;

a roller disposed on a rotational shaft to be rotatable in an inner space of the cylinder and eccentrically located with respect to a center of the compression space to have a contact point close to an inner circumferential surface of the cylinder;

a plurality of vanes slidably inserted into a plurality of vane slots disposed in the roller, respectively, and configured to rotate together with the roller to divide the compression space into a plurality of compression chambers; and an injection passage configured to inject a part of refrigerant having been discharged from the compression space and condensed into the compression space, wherein the injection passage is disposed in at least one among the main bearing, the sub bearing, and the cylinder to communicate with a corresponding compression chamber among the plurality of compression chambers, after a compression start angle of the corresponding compression chamber, wherein the injection passage comprises an injection inlet recessed from an outer circumferential surface of the cylinder toward the inner circumferential surface of the cylinder by a preset depth, and at least one injection outlet in communication with the injection inlet to penetrate through the inner circumferential surface of the cylinder, wherein the at least one injection outlet comprises a plurality of injection outlets, and wherein the plurality of injection outlets is arranged to be spaced apart from each other by a preset distance in an axial direction, or wherein the injection passage comprises:

a first injection passage disposed in one bearing among the main bearing and the sub bearing;

a second injection passage disposed in another bearing among the main bearing and the sub bearing, wherein the first injection passage is not disposed in the another bearing; and an injection connection passage that connects the first injection passage to the second injection passage.

2. The rotary compressor of claim 1, wherein the injection passage satisfies $\theta \leq$an application area of the injection passage$\leq \theta+360/n$, where $\theta$ is the compression start angle and n is a number of the plurality of vanes.

3. The rotary compressor of claim 2, wherein a circumferential width of the injection passage is configured as 0.4 to 0.8 times a thickness of each of the plurality of vanes.

4. The rotary compressor of claim 3, wherein the injection passage is disposed to communicate with the corresponding compression chamber within a range of 20° after the compression start angle with reference to a rotational direction of the roller.

5. The rotary compressor of claim 1, wherein the injection outlet is configured such that an axial length is greater than a circumferential length.

6. The rotary compressor of claim 1, wherein the injection passage comprises an injection inlet recessed from an outer circumferential surface of the main bearing or an outer circumferential surface of the sub bearing toward an inner circumferential surface of the main bearing or an inner circumferential surface of the sub bearing by a preset depth, and an injection outlet in communication with the injection inlet to penetrate through a sliding surface toward the compression space.

7. The rotary compressor of claim 6, wherein the injection outlet is configured as one injection outlet.

8. The rotary compressor of claim 6, wherein the injection outlet is configured such that a radial length is greater than a circumferential length.

9. The rotary compressor of claim 6, wherein the plurality of vanes is disposed to be inclined at a preset angle with respect to a radial direction with reference to a rotational center of the roller, and wherein the injection outlet is disposed to have a length in a direction in which the plurality of vanes is inclined.

10. The rotary compressor of claim 1, wherein the injection connection passage is disposed through both axial side surfaces of the cylinder.

11. The rotary compressor of claim 1, wherein the injection passage comprises an injection hole that penetrates through both axial side surfaces of the main bearing or the sub bearing, and an injection pipe connected into the injection hole from outside of the main bearing or the sub bearing.

12. The rotary compressor of claim 1, wherein a valve accommodating space is disposed in the injection passage, a valve support surface is disposed on an inner circumferential surface of the valve accommodating space, and an injection pipe is disposed at a side opposite to the valve support surface to communicate with the valve accommodating space, and an injection check valve is disposed between the valve support surface and the injection pipe to open or close the injection passage by sliding according to a pressure difference.

13. The rotary compressor of claim 1, wherein a valve accommodating groove in which an injection check valve configured to open or close the injection passage is accommodated is disposed in an inner side surface defining the compression space in the main bearing, the sub bearing, and the cylinder to communicate with the injection passage, a valve support member having a valve support surface to fix one end of the injection check valve and limit an opening amount of another end of the injection check valve is inserted into the valve accommodating groove to have the injection check valve between the valve accommodating groove and the valve support member, and the injection passage is disposed to extend between an inner circumferential surface of the valve accommodating groove and an outer circumferential surface of the valve support member.

14. The rotary compressor of claim 1, wherein a valve accommodating groove in which an injection check valve configured to open or close the injection passage is accommodated is disposed in outer surfaces of the main bearing, the sub bearing, and the cylinder to communicate with the injection passage, a valve support member configured to fix one end of the injection check valve and support another end of the injection check valve is inserted into the valve accommodating groove to have the injection check valve between the valve accommodating groove and the valve support member, and an injection hole defining the injection passage is disposed in the valve support member.

15. A refrigeration cycle device comprising a compressor, a condenser, an expander, and an evaporator, and having a rotary compressor applied to the refrigeration cycle device, wherein the compressor comprises:

a casing;

a main bearing and a sub bearing each disposed in an inner space of the casing;

a cylinder disposed between the main bearing and the sub bearing to define a compression space;

a roller disposed on a rotational shaft to be rotatable in the inner space of the cylinder and eccentrically located with respect to a center of the compression space to have a contact point close to an inner circumferential surface of the cylinder;

a plurality of vanes slidably inserted into a plurality of vane slots disposed in the roller, respectively, and configured to rotate together with the roller to divide the compression space into a plurality of compression chambers; and an injection passage configured to inject a part of refrigerant having been discharged from the compression space and condensed into the compression space, wherein the injection passage is disposed in at least one among the main bearing, the sub bearing, and the cylinder to communicate with a corresponding compression chamber among the plurality of compression chambers, after a compression start angle of the corresponding compression chamber, wherein the injection passage comprises an injection inlet recessed from an outer circumferential surface of the cylinder toward the inner circumferential surface of the cylinder by a preset depth, and at least one injection outlet in communication with the injection inlet to penetrate through the inner circumferential surface of the cylinder, wherein the at least one injection outlet comprises a plurality of injection outlets, wherein the plurality of injection outlets is arranged to be spaced apart from each other by a preset distance in an axial direction, or wherein the injection passage comprises:

a first injection passage disposed in one bearing among the main bearing and the sub bearing;

a second injection passage disposed in another bearing among the main bearing and the sub bearing, wherein the first injection passage is not disposed in the another bearing; and an injection connection passage that connects the first injection passage to the second injection passage.

16. The refrigeration cycle device of claim 15, wherein an injection portion branched between the condenser and the expander to be connected to the injection passage is disposed, and an injection control valve configured to selectively open or close the injection portion is disposed in the injection portion, and the injection control valve is controlled such that a pressure of a refrigerant injected into the corresponding compression chamber is 0.4 to 0.7 times a discharge pressure of a refrigerant discharged from the corresponding compression chamber.

* * * * *